US007075025B2

(12) United States Patent
Tomitsuka et al.

(10) Patent No.: US 7,075,025 B2
(45) Date of Patent: Jul. 11, 2006

(54) SWITCH SHEET AND SWITCH

(75) Inventors: Toshimizu Tomitsuka, Tokyo (JP); Shoji Ajimura, Kanagawa (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 10/634,868

(22) Filed: Aug. 6, 2003

(65) Prior Publication Data

US 2004/0129547 A1 Jul. 8, 2004

(30) Foreign Application Priority Data

Aug. 9, 2002 (JP) ..... P2002-233816
Jan. 27, 2003 (JP) ..... P2003-017136
Apr. 4, 2003 (JP) ..... P2003-101522
Apr. 24, 2003 (JP) ..... P2003-120279

(51) Int. Cl.
*H01H 3/12* (2006.01)

(52) U.S. Cl. ..... 200/512; 200/516; 200/517; 200/6 A

(58) Field of Classification Search ..... 200/5 A, 200/6 A, 511, 512, 516, 517
See application file for complete search history.

(56) References Cited

U.S. PATENT DOCUMENTS 4,071,718 A 1/1978 Harden et al.
4,086,451 A * 4/1978 Boulanger ..... 200/5 A
4,163,138 A 7/1979 Harden
4,323,740 A 4/1982 Balash et al.
4,349,708 A 9/1982 Asher et al.
5,924,555 A * 7/1999 Sadamori et al. ..... 200/512
5,950,808 A * 9/1999 Tanabe et al. ..... 200/314
5,986,228 A * 11/1999 Okamoto et al. ..... 200/516
6,373,008 B1 * 4/2002 Saito et al. ..... 200/310
6,417,467 B1 * 7/2002 Yamagata ..... 200/5 A
6,586,689 B1 * 7/2003 Kuriyama ..... 200/6 A
6,743,994 B1 * 6/2004 Adachi ..... 200/512
2001/0006143 A1 7/2001 Sato

FOREIGN PATENT DOCUMENTS

EP 0 444 914 A 9/1997
EP 0 801 517 A 10/1997
EP 1 035 557 A 9/2000

* cited by examiner

*Primary Examiner*—Michael A. Friedhofer
(74) *Attorney, Agent, or Firm*—Sughrue Mion, PLLC

(57) ABSTRACT

A switch sheet and switch utilizing the switch sheet are provided, wherein the switch sheet utilizes a dome shaped spring, and is structured such that the dome shaped spring can be definitively clicked in the center part and operate effectively even when the dome shaped spring is miniaturized. In addition to having long-lasting, superior durability, this switch sheet provides an improved click ratio enabling miniature devices with a good clicking sensation to be achieved. This switch sheet comprises a dome shaped spring, resin sheeting adhered to the external surface of this dome shaped spring via an adhesive agent, and a rigid member positioned on the outside of this resin sheeting, having a downward facing protrusion part formed to oppose the center part of said dome shaped spring.

43 Claims, 10 Drawing Sheets

SWITCH SHEET AND SWITCH

CROSS REFERENCE TO RELATED APPLICATIONS

This application claims benefit of priority to Japanese Patent Application No. 2002-233816 filed on Aug. 9th, 2002, Japanese Patent Application No. 2003-17136 filed on Jan. 27th, 2003, Japanese Patent Application No. 2003-101522 filed on Apr. 4th, 2003 and Japanese Patent Application No. 2003-120279 filed on Apr. 24th 2003, the entire contents of which are incorporated by reference herein.

BACKGROUND OF THE INVENTION

1. Field of the Invention

The present invention relates to a switch sheet with a dome shaped conductive spring (hereinafter referred to as a "dome shaped spring") and a switch that utilizes such switch sheet, which is used in electronic equipment such as a portable telephone.

2. Description of Relevant Art

Dome shaped springs are used in pushbutton switches used to turn various kinds of electronic equipment such as a portable telephone, on or off. In order to make contact with a fixed contact occur through operation of a switch, a dome shaped spring must undergo distortion of its shape in response to compression load many times over. Accordingly, thin stainless sheeting is used for this kind of dome shaped spring.

FIG. 1 illustrates an example of the pushbutton switch. There, for the pushbutton switch or switch sheet 101, dome shaped spring 102 is secured to ring shaped fixed contact 106 of printed wired substrate 105, adhered together with plastic sheeting 104 by adhesive agent 103. Dome shaped spring 102 is usually made from thin stainless steel sheeting. When, through actuator 107 located above the center of dome shaped spring 102, spring 102 is clicked via plastic sheeting 104 of switch sheet 101, spring 102 depresses inwards coming into contact with circuit conductor 108, thereby causing conduction between fixed contact 106 and circuit conductor 108. Technology of this kind has been disclosed in Japanese Patent Publication No. 2002-216582.

With this kind of switch, it is preferable for actuator 107 to click the center region of dome shaped spring 102 when this kind of switching operation is performed repeatedly. However, it is very easy for actuator 107 to become positionally misaligned in relation to dome shaped spring 102. The smaller the equipment used, the more pronounced this phenomena becomes. It is therefore necessary to consider solutions appropriate for increasingly miniaturized devices. Due to this problem of misaligned positioning, there is not a smooth tactile response when using electronic equipment (e.g., a portable telephone), and a poor sensation is felt. The clicking of the switch is not perceived distinctly by the fingers. This phenomena called the clicking sensation can be expressed in terms of a click ratio. The click ratio can be expressed as (P1−P2)/P1×100, where (P1) is the load of maximum value a for load—displacement curve, for the dome shaped spring shown in FIG. 3 and (P2) is the load of minimum value b. This expression indicates the clicking sensation. The clicking sensation decreases as the value for the click ratio decreases. A click ratio of 30% or greater is preferable.

Different structures that realize a high click ratio have been investigated. However, to date, nothing satisfactory has been achieved. (See the inventions disclosed in Japanese Patent Publication No. 2001-135189 and Japanese Patent Publication No. 2000-188036 for example.) Furthermore, as mentioned, as electronic devices (e.g., portable telephones) become increasingly small, dome shaped springs also are becoming increasingly miniaturized. Also, actuators are being incorporated with the precision of maximum about 0.5 mm. This makes the problem of a decreasing click sensation through misaligned positioning between a dome shaped spring and actuator still more difficult to resolve. Further, the parts forming a dome shaped spring must be more durable and last longer. Technology that solves these problems is required.

FIGS. 2A and 2B illustrates an enlarged view of examples of dome shaped springs 102. The spring in FIG. 2A is the more standard one used. The spring in FIG. 2B has an upward protrusion 109. A switch including this upward protrusion type is said to be a switch wherein it is comparatively difficult for there to be a deterioration in the clicking sensation when pressed from a point away from center. It is known that where this type of switch is assembled into an electronic device, when the actuator is clicked, if the position of the click is directed from off center of the dome shaped spring, there is no deterioration in the sensation of the clicking operation. However, it frequently happens with a switch including dome shaped spring 102 shown in FIG. 2B, that the upward protrusion 109 is buried in plastic sheeting 104 (FIG. 1) causing the click of dome shaped spring 102 to be out of position.

In the above-mentioned switch, there is a multi-directionally operable switch with directional keys and an execution key. Through one actuator, this multi-directionally operable switch can click in the directions of a cross shape or a central part. Such a multi-directionally operable switch is shown in FIGS. 1, 3, 4 and 5 of Japanese Patent Publication No. 11-331329 in which it is referred to as a multi-function key.

With this multifunction key also, when as described, the clicking operation is performed repeatedly, the problem of misaligned positioning arises causing a poor clicking sensation. Technology that answers the needs of these increasingly miniaturized devices is required but as yet, nothing satisfactory has been devised.

SUMMARY OF THE INVENTION

The present invention solves the above-mentioned problems affecting technology of the prior part. The object of the present invention is to realize a structure for a switch sheet utilizing a spring member, wherein even when miniaturized, the spring member can be clicked sufficiently definitively in the center part. Further, the object is to provide a switch sheet and a switch utilizing such switch sheet, that, in addition to being highly durable and long-lasting, enables realization of a miniature device with an improved click ratio and a good clicking sensation when the switch is operated.

A further object of the present invention is to realize a structure for a multi-directionally operable switch sheet utilizing a spring member, wherein even when miniaturized, the spring member can be clicked sufficiently definitively in the center part.

Further, the object is to provide a multi-directionally operable switch sheet and a multi-directionally operable switch utilizing such switch sheet, which enable realization of electronic equipment such as a portable telephone with an improved click ratio and a good clicking sensation when the switch is operated.

According to one aspect of the present invention, in order to realize these objectives, the present invention provides a switch sheet comprising a spring member; a resin sheet supported by an external surface of said spring member, and a substantially rigid member positioned adjacent to said resin sheet, comprising a protrusion part protruding towards a center part of said spring member.

According to other aspects of the present invention the spring member is generally dome-shaped, the external surface of said spring member is a convex side of said dome-shape, the substantially rigid member is substantially planar, and said protrusion part protrudes substantially orthogonally from said substantially rigid member, the substantially rigid member is made of sheet metal, the resin sheet substantially covers said spring member, the protrusion part is in contact with said resin sheet, the protrusion part is spaced apart from said resin sheet by a predetermined distance, and the resin sheet is adhered to said spring member by an adhesive.

According to another aspect of the present invention, the invention provides a switch sheet comprising a spring member, a resin sheet supported by an external surface of said spring member, and a substantially rigid member positioned adjacent to said resin sheet, comprising a protrusion part protruding towards a center part of said spring member, and a circumferential portion adhered to said resin sheet.

According to other aspects of the present invention, the spring member is generally dome-shaped, the external surface of said spring member is a convex side of said dome-shape, the substantially rigid member is substantially planar, and said protrusion part protrudes substantially orthogonally from said substantially rigid member, the substantially rigid member is made of sheet metal, the resin sheet substantially covers said spring member, the protrusion part is in contact with said resin sheet, the protrusion part is spaced apart from said resin sheet by a predetermined distance, and the resin sheet is adhered to said spring member by an adhesive.

According to another aspect of the present invention, the invention provides a switch sheet comprising a plurality of spring members positioned at defined intervals, a resin sheet supported by external surfaces of said spring members, and a substantially rigid member positioned adjacent to said resin sheet, comprising a plurality of protrusion parts, each protrusion part protruding toward center parts of each of said spring members.

According to other aspects of the present invention, the spring members are generally dome-shaped, the external surfaces of said spring members are convex sides of said dome-shapes, the substantially rigid member is substantially planar, and said protrusion parts protrude substantially orthogonally from said substantially rigid member, the substantially rigid member is made of sheet metal, the resin sheet substantially covers each of said plurality of spring members, each of said plurality of protrusion parts is in contact with said resin sheet, each of said plurality of protrusion parts is spaced apart from said resin sheet by a predetermined distance, and the resin sheet is adhered to said plurality of spring members by an adhesive.

According to another aspect of the present invention, the invention provides a switch sheet comprising a resin sheet, a spring member supporting said resin sheet on an external side, said spring member comprising a rotationally symmetrical axis, and a substantially rigid member provided adjacent to said resin sheet, wherein said resin sheet comprises a flat portion surrounding a part that is supported by said spring member, said substantially rigid member further comprises a protrusion part that protrudes toward said spring member and a circumferential portion that is secured to said flat portion of said resin sheet, and an axis along a direction of extension of said protrusion part is aligned with said rotationally symmetrical axis of said spring member.

According to other aspects of the present invention, the spring member is generally dome-shaped, the external surface of said spring member is a convex side of said dome-shape, the substantially rigid member is substantially planar, and said protrusion part protrudes substantially orthogonally from said substantially rigid member, the resin sheet substantially covers said spring member, the resin sheet extends outwardly beyond an external periphery of said spring member, a circumferential portion of said substantially rigid member and said resin sheet are secured to each other, a circumferential portion of said substantially rigid member and said resin sheet are secured to each other via an interposed plastic sheet, a distal end of said protrusion part of said substantially rigid member is in contact with said resin sheet covering said spring member, the substantially rigid member is made of sheet metal, the protrusion part comprises a generally cylindrical shape with a diameter between 0.5 and 3.0 mm, a cross-sectional shape of said protrusion part is, pan bottomed, trapezoidal, rectangular, cylindrical or triangular, the substantially rigid member of sheet metal is shaped to be formed by a sheet metal pressing process, the protrusion part is spaced apart from said resin sheet by a predetermined distance, the resin sheet is adhered to said dome shaped spring by an adhesive.

According to another aspect of the present invention, the invention provides a switch sheet for a multi-directionally operable switch having an execution key and a directional key, comprising a plurality of spring members positioned to correspond to said execution key and said directional key, a resin sheet supported by external surfaces of said spring members, and a substantially rigid member positioned adjacent to said resin sheet, comprising a plurality of protrusion parts, each protrusion part being formed in position so as to correspond to each center part of said spring members, and a circumferential portion connected to said resin sheet.

According to other aspects of the present invention, the spring members are generally dome-shaped, the external surfaces of said spring members are convex sides of said dome-shapes, the substantially rigid member is substantially planar, and said protrusion parts protrude substantially orthogonally from said substantially rigid member, the substantially rigid member is made of sheet metal, the resin sheet substantially covers each of said plurality of spring members, each of said plurality of protrusion parts is in contact with said resin sheet, each of said plurality of protrusion parts is spaced apart from said resin sheet by a predetermined distance, the resin sheet is adhered to said plurality of spring members by an adhesive, the spring members are generally arranged in a cross shape, wherein one of said spring members is positioned at a center of said cross shape and others of said spring members are positioned at prescribed locations in four directions from said center, the substantially rigid member forms an arrangement of a square with two lines therein, said two lines are perpendicular to each other and intersect in a center of said square, and the substantially rigid member is connected to said resin sheet only at four corners of said arrangement of a square with two lines therein, and has a plastic sheeting arranged therebetween.

According to another aspect of the present invention, the invention provides a switch comprising a substrate comprising a fixed contact and a conducting circuit arranged thereon, a spring member positioned on a surface of said substrate via said fixed contact, a resin sheet supported by an external surface of said spring member and said surface of said substrate, a substantially rigid member positioned adjacent to said resin sheet and supported by a supporting member, comprising a protrusion part protruding towards a center part of said spring member; and an actuator positioned adjacent to said substantially rigid member such that it can depress said center part of said spring member via said substantially rigid member to enable conduction.

According to other aspects of the present invention, the spring member is generally dome-shaped, the external surface of said spring member is a convex side of said dome-shape, the substantially rigid member is substantially planar, and said protrusion part protrudes substantially orthogonally from said substantially rigid member, the substantially rigid member is made of sheet metal, the resin sheet substantially covers said spring member, the protrusion part is in contact with said resin sheet, the protrusion part is spaced apart from said resin sheet by a predetermined distance, and the resin sheet is adhered to said spring member by an adhesive.

According to another aspect of the present invention, the invention provides a switch comprising a substrate comprising a fixed contact and a conducting circuit arranged thereon, a plurality of spring members positioned on a surface of the substrate via the fixed contact, a resin sheet supported by external surfaces of said spring members and said surface of said substrate, a substantially rigid member positioned adjacent to said resin sheet and supported by a supporting member, comprising a plurality of protrusion parts protruding towards said spring members, and corresponding, respectively, to a center part of each of said spring members, and an actuator positioned adjacent to said substantially rigid member such that it can depress said center part of said spring member via said substantially rigid member to enable conduction.

According to other aspects of the present invention, the spring members are generally dome-shaped, the external surfaces of said spring member are convex sides of said dome-shapes, the substantially rigid member is substantially planar, and said protrusion parts protrude substantially orthogonally from said substantially rigid member, the substantially rigid member is made of sheet metal, the resin sheet substantially covers each of said plurality of spring members, each of said plurality of protrusion parts is in contact with said resin sheet, each of said plurality of protrusion parts is spaced apart from said resin sheet by a predetermined distance, and the resin sheet is adhered to said plurality of spring members by an adhesive.

According to another aspect of the present invention, the invention provides a switch comprising a substrate comprising a fixed contact and a conducting circuit arranged thereon, a spring member having a rotationally symmetrical axis, and arranged on said substrate such that an external periphery thereof contacts said fixed contact and said conducting circuit is arranged along said rotationally symmetrical axis, a resin sheet supported by an external surface of said spring member and said surface of said substrate, a substantially rigid member positioned adjacent to said resin sheeting and supported by a supporting member, and an actuator positioned adjacent to said substantially rigid member and substantially along said rotationally symmetrical axis, wherein if said actuator is moved along said rotationally symmetrical axis, said spring member is depressed via said substantially rigid member to contact said conducting circuit, said resin sheet has a flat portion that is connected to said surface of said substrate, and said substantially rigid member further comprises a cylindrically shaped protrusion part that protrudes toward said spring member, and a circumferential part that is secured to said flat portion of said resin sheet, wherein an axis of said cylindrically shaped protrusion part is aligned with said rotationally symmetrical axis of said dome shaped spring.

According to other aspects of the present invention, the spring member is generally dome-shaped, the external surface of said spring member is a convex side of said dome-shape, the substantially rigid member is substantially planar, and said protrusion part protrudes substantially orthogonally from said substantially rigid member, the substantially rigid member is made of sheet metal, the resin sheet substantially covers said spring member, the protrusion part is in contact with said resin sheet, the protrusion part is spaced apart from said resin sheet by a predetermined distance, and the resin sheet is adhered to said spring member by an adhesive.

According to another aspect of the present invention, the invention provides a multi-directionally operable switch comprising a printed wired substrate having a fixed contact and a conducting circuit arranged thereon, a plurality of spring members generally arranged to form a cross shape, connected to said printed wired substrate via said fixed contact, and supporting a resin sheet on external surfaces thereof, a substantially rigid member positioned adjacent to said spring members and connected to said resin sheet by plastic sheeting, said rigid member comprising a plurality of protrusion parts protruding towards said spring members and corresponding to a center part of each of said spring members, and an actuator positioned on an opposite side of said rigid member from said protrusion parts.

According to other aspects of the present invention, the spring members are generally dome-shaped, the external surfaces of said spring members are convex sides of said dome-shapes, the substantially rigid member is substantially planar, and said protrusion parts protrude substantially orthogonally from said substantially rigid member, the substantially rigid member is made of sheet metal, the resin sheet substantially covers each of said plurality of spring members, each of said plurality of protrusion parts is in contact with said resin sheet, each of said plurality of protrusion parts is spaced apart from said resin sheet by a predetermined distance, and the resin sheet is adhered to said spring members by an adhesive.

BRIEF DESCRIPTION OF THE ACCOMPANYING DRAWINGS

The above described and other objectives and configurations of the present invention will be further clarified by an explanation of suitable embodiments according to the invention with reference to the accompanying drawings in which.

DETAILED DESCRIPTION OF EXEMPLARY EMBODIMENTS

Exemplary embodiments of the present invention will now be described with reference to the drawings. The described exemplary embodiments are intended to assist the understanding of the invention, and are not intended to limit the scope of the invention in any way. The same numbers are used to refer to similar parts.

A first exemplary embodiment of a switch according to the invention will now be described. Generally, in a switch of the first embodiment, a switch sheet comprising a dome shaped spring (spring member) with resin sheeting (resin sheet) adhering thereto via adhesive agent is arranged on the surface of a substrate via a fixed contact on the substrate, while thereon an actuator is positioned such that it can click the center part of the dome shaped spring and cause conduction. In this switch the switch sheet comprises a dome shaped spring, sheeting adhered on that dome shaped spring and sheet metal member (substantially rigid member) secured into position thereabove having a downward facing protrusion part formed in the part corresponding to the center part of the dome shaped spring. With this construction, an actuator can definitively click the center part of dome shaped spring, bringing contact with the circuit conductor, causing conduction. Further, this enables electronic equipment with an improved click ratio and a good clicking sensation suitable for a miniaturized device to be realized and it provides superior durability in relation to the frequency of clicking operations performed.

Figure 4A:
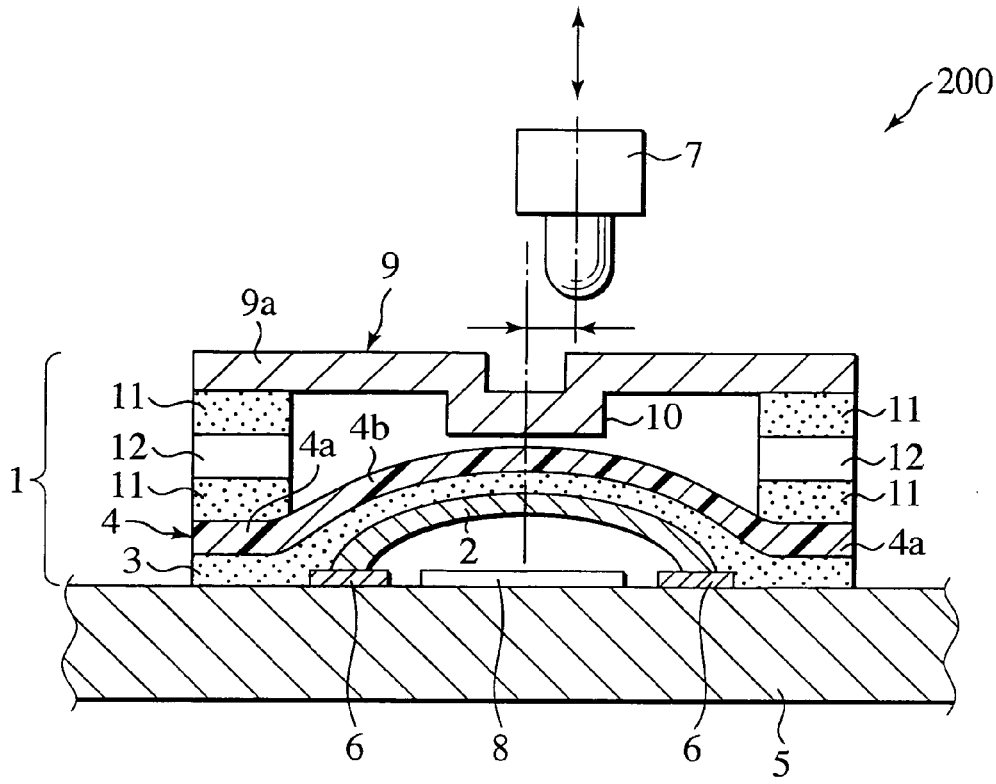
FIG. 4A is a schematic cross-sectional view of a first exemplary embodiment of a switch according to the present invention.

More specifically, as shown in FIG. 4A, a switch 200 has a switch sheet 1 that has dome shaped spring 2 with resin sheeting 4 adhering thereon via adhesive agent 3; dome shaped spring 2 is positioned against a fixed contact 6 on a substrate 5. An actuator 7 is arranged on the upper part of switch sheet 1, so as to be able to click the center part of spring 2, causing conduction between contact 6 and conducting circuit 8 on substrate 5. Specifically, in this switch 200, switch sheet 1 comprises dome shaped spring 2, resin sheeting 4 adhered thereon and sheet metal member 9 secured into position thereabove. This sheet metal member 9 is formed with a downward facing protrusion part 10 in the part precisely above the center part of spring 2. With this construction, the actuator 7 definitively clicks the center part of spring 2 causing contact with circuit conductor 8 and causing conduction between fixed contact 6 and circuit conductor 8. Further, this enables electronic equipment with an improved click ratio and a good clicking sensation suitable for a miniaturized device to be realized and it provides superior durability in relation to the frequency of clicking operations performed.

Even when the actuator causes misaligned positioning, protrusion part 10 definitively clicks the center part of dome shaped spring 2 causing conduction with circuit conductor 8. This enables miniature equipment such as a portable telephone with an improved click ratio and a good clicking sensation to be realized. Further, as sheet metal member 9 having protrusion part 10 is fixed at circumferential portion, adhered to the resin sheeting 4 through plastic sheeting with adhesive agent layer 11 applied on both surfaces, a switch that occupies a small space and has a high degree of sensitivity is achievable. This switch has a good clicking sensation, and superior durability and resistance to corrosion because it utilizes a highly rigid sheet metal member. Again, from a production costs perspective also, manufacturing using pressing processes is both cost-effective and practical.

The dome shaped spring 2 may be formed of sheeting metal and may have a dome shaped part formed in its center region, and may have at least a pair of opposed lobes that protrudes either horizontally or in a somewhat upward direction at the external peripheral region at the bottom of each dome part. With a switch sheet 1 using a dome shaped spring 2 so structured, even if the spring 2 is miniaturized such that its external diameter is about 3 to 4 mm, there is not significant distortion due to shape transformation caused by clicking and durability does not deteriorate in relation to the frequency of clicks performed. Basically, even if the external diameter is 4 mm or less, no rupturing occurs after up to one million clicks where P1 load is 2.0 N or greater. A switch sheet 1 utilizing this dome shaped spring 2 has superior durability. Moreover, in this embodiment, the lobes are 200 μm or less high and 0.3 to 1.0 mm wide. Further, in this embodiment, the protruding lobe has no burrs from the fabrication process on the side of fixed contact 6 of wired substrate 5. With these dimensions there is no substantial shape distortion and consequent deterioration in durability in relation to the number of clicks made.

A first exemplary embodiment of the switch sheet according to the invention will now be described. Generally, this switch sheet has a dome shaped spring, resin sheeting adhered to the external surface of this dome shaped spring via an adhesive agent, sheet metal member positioned above the outside of this resin sheeting and having a downward facing protrusion part formed opposing the center part of the dome shaped spring. Specifically, in this embodiment, the switch sheet has a dome shaped spring, resin sheeting applied, adhering to the surface of that spring, and sheet metal member positioned thereabove, having a downward facing protrusion part in the part-precisely above the center part of the dome shaped spring, circumferential portion of which sheet metal member are secured to a portion of resin sheeting around the dome shaped spring through plastic sheeting and an adhesive agent. This construction can operate effectively even with a miniaturized dome shaped spring. Further, the dome shaped spring can be definitively clicked in the center part. Moreover, this embodiment realizes a switch sheet suitable for use with miniature equipment, which in addition to being highly durable and long-lasting, has an improved click ratio and a good clicking sensation.

Figure 4B:
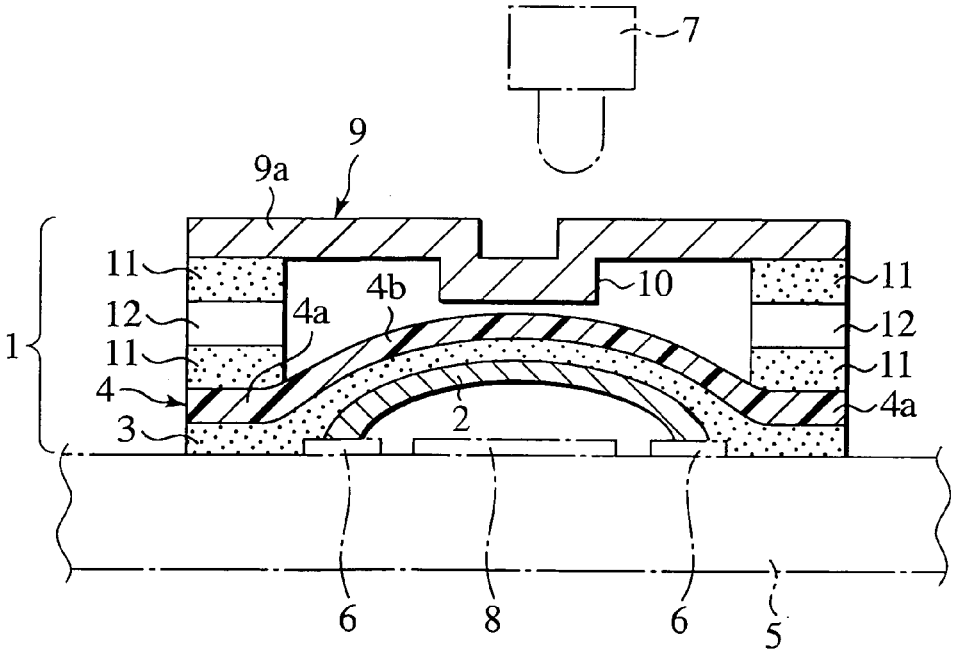
FIG. 4B is a schematic cross-sectional view of a switch sheet of the switch shown in FIG. 4A.

This embodiment will now be described in detail with reference to FIG. 4B. In FIG. 4B, the switch sheet 1 is adapted to be installed for example on fixed contacts 6 of printed wired substrate 5. Basically, resin sheeting 4 that can be formed of a kind of resin material, adheres to the external surface of dome shaped spring 2 by adhesive agent 3. The dome shaped spring 2 may be adhered to the resin sheeting 4 by substantial entirety of the external surface on convex side. Sheet metal member 9 forming downward facing protrusion part 10 positioned corresponding to the center part of dome shaped spring 2, is itself arranged such that an actuator 7 can definitively click the center part of dome shaped spring 2. In this embodiment, the circumferential portion of sheet metal member 9 is adhered and secured in position of resin sheeting 4 by plastic sheeting 12 and adhesive agent 11. In a switch utilizing switch sheet 1 so constructed, the center part of dome shaped spring 2 can be definitively clicked from the actuator. Thus, dome shaped spring 2 contacts with circuit conductor 8, causing conduction between fixed contacts 6 and circuit conductor 8.

More specifically, normally, due to its stability, thin sheeting of stainless metal of a thickness of 40 to 80 μm is used for dome shaped spring 2. Resin sheeting 4, of for example polyethylene terephthalate (PET), adhered to the surface of spring 2, is of a thickness of 25 to 100 μm. This resin sheeting 4 adheres to dome shaped spring 2 by adhesive agent 3, with its circumferential portion fixed to substrate 5 and fixed contacts 6. There are no specific requirements for adhesive agent 3, and any substance normally so used is acceptable. Sheet metal member 9 having a protrusion part 10 formed facing downwards, is installed above resin sheeting 4 with the protrusion part 10 being positioned above the center part of spring 2. This sheet metal member 9, of for example stainless steel, is of a thickness of 30 to 100 μm.

A suitable material for this sheet metal member 9 is a highly rigid material, basically a metal with a Young's modulus of between 70 to 200 GPa. Metals with this Young's modulus include stainless steel and copper based alloys like brass or phosphor bronze, aluminum or an aluminum alloy. In terms of providing the requisite clicking sensation, durability and corrosion resistance suitable for the switch sheet, stainless steel may be used.

Figure 5:
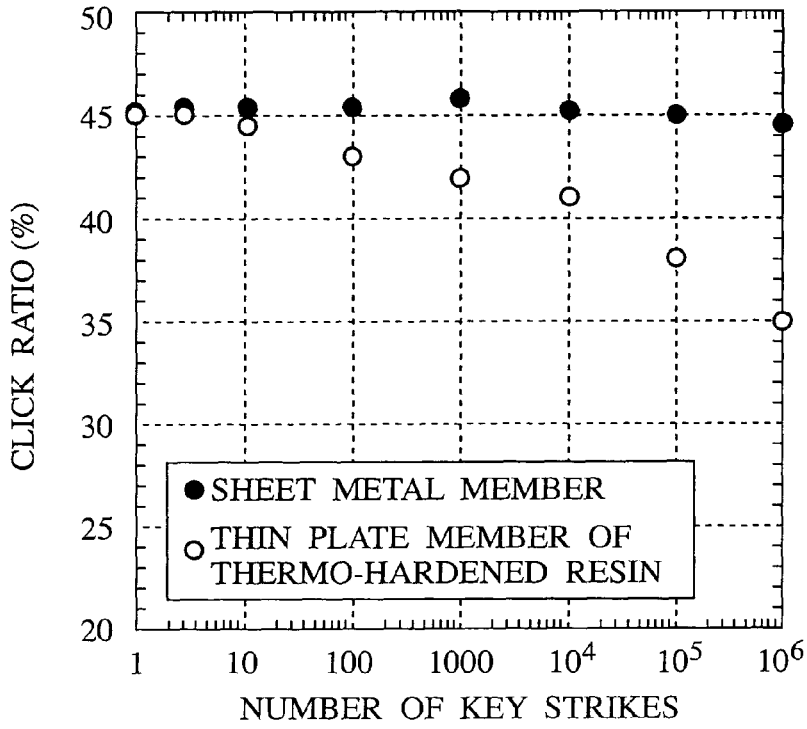
FIG. 5 is a graph showing the relationship between the click ratio and frequency of key strikes performed from exemplary comparative rigid members.

FIG. 5 shows the durability where stainless steel is used. An experiment was conducted on key striking to show the relationship between the number of key strikes (the frequency of clicking) and the click ratio, in which sheet metal member 9, a thin plate of stainless steel 50 μm thick in which was formed a protrusion part 0.14 mm high and 2.0 mm in diameter was compared with a thin plate member of thermo-hardened resin forming a protrusion part of the same dimensions. An aluminum rod of 2 mm ϕ was used for the strike key (actuator), and clicking of a load of 5 N was repeated. The results shown in FIG. 5 indicate that using sheet metal member 9 of stainless steel, even with a click frequency of one million times there was virtually no deterioration in the click ratio. This is a very high value. In contrast to this, where the thin plate member of thermo-hardened resin was tested, the click ratio deteriorated in line with the increased click frequency and after one million clicks, the click ratio had fallen to 35%. This is because the diameter of the protrusion part increases in line with the increase in the click frequency, it's height shortening to produce a change in shape. In contrast to this however virtually no such shape change was evident when the sheet metal member of stainless steel was tested indicating that it is a material of superior durability.

In this embodiment, protrusion part 10 of the sheet metal member has a diameter of 1 mm and a height of 0.2 to 1.0 mm. With these dimensions a suitable click sensitivity can be achieved even with an actuator that is 1.5 to 2.0 mm made for example of silicone gum or polycarbonate. Also in this embodiment, the downward facing protrusion part 10 of sheet metal member 9 has a diameter of 0.5 to 3.0 mm. Using a sheet metal member 9 having a protrusion part 10 with a diameter specified to those dimensions, even when the click from the actuator is positionally misaligned away from the center of the dome shaped spring 2, due to the rigidity of sheet metal member 9 protrusion part 10 clicks the center part of spring 2. This means that a suitable switch sheet with a good click sensation and a high click ratio can be obtained using such member in these dimensions.

Figure 6:
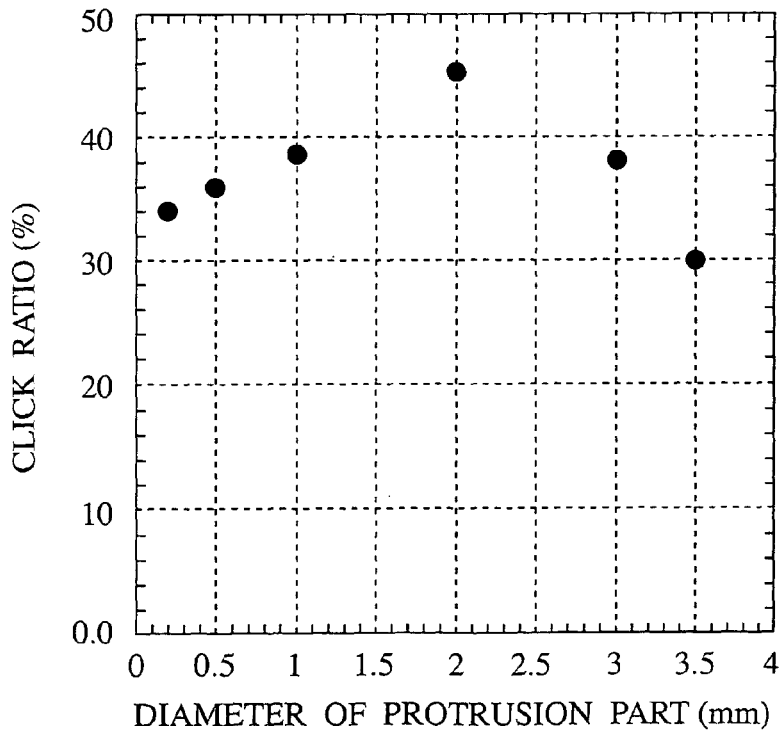
FIG. 6 is a graph showing the relationship between the click ratio and the diameter of a protrusion part of an exemplary rigid member.

FIG. 6 shows the relationship between the click ratio and the diameter of protrusion part 10 when a dome shaped spring 2 with an outside diameter of 4 mm is used. If the diameter of the protrusion part is less than 0.5 mm or exceeds 3.0 mm the click ratio is less than 35%, indicating a deterioration in the clicking properties or clicking sensitivity. When the diameter of the protrusion part is less than 0.5 mm, in addition to the protrusion part having low durability, the processes for production are also difficult. When the diameter of the protrusion part exceeds 3.0 mm the base portion 9*a* of sheet metal member 9 that surrounds and supports the protrusion part 10 is too small, and the degree of durability deteriorates. Accordingly, a protrusion part 10 of sheet metal member of a diameter of 0.5 to 3.0 mm may be used.

Figure 7A:
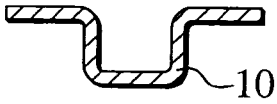
FIGS. 7A, 7B and 7C are schematic cross-sectional views of exemplary protrusion parts of rigid members according to the present invention.
Figure 7B:
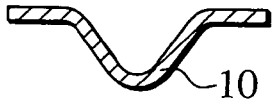

The cross-sectional shape of protrusion part 10 of the sheet metal member may be, pan bottomed, trapezoidal, rectangular, cylindrical and trianglular. Thus formed, a click of the actuator definitively clicks the top part of the dome of dome shaped spring 2. The basic shape used is shown in FIGS. 4A, 7A and 7B.

It is practical for sheet metal member 9 to be formed by metal pressing processes.

Figure 7C:
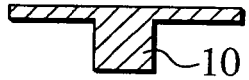

The desired sheet metal member 9 with downward facing protrusion part 10 could be made for example by press processing using a bottom press with a depression and a top press having a protrusion part corresponding to the depression. This kind of press processing does not require dies of complex shape and is advantageous from the aspect of production costs also. The form of protrusion part 10 shown in FIG. 7C can be formed through machining processes for example. Thus, the method of forming this sheet metal member 9 need not be restricted solely to pressing processes.

The relationship between dome shaped spring 2 and resin sheeting 4 adhered to the external surface of spring 2 will now be described in detail referring again to FIG. 4B. In this embodiment, adhesive agent 3 and resin sheeting 4 of the dome shaped spring extend beyond the periphery of dome shaped spring 2 to the outside region. When constructed in this way, resin sheeting 4 can adhere to substrate 5 so that even when the clicking through the actuator is repeated over and over, it is difficult for dome shaped spring 2 to get out of position with fixed contacts 6.

In this embodiment, both circumferential portions of sheet metal member 9 and resin sheeting 4 to be secured to each other. This provides a stable configuration for switch sheet 1 wherein protrusion part 10 does not get misaligned out of position from the center part of the dome of dome shaped spring 2 through repeated clicking from the actuator, allowing a switch sheet 1 with a high click ratio to be realized. With a switch 1 of this type, even if the actuator causes such erroneous positioning, protrusion part 10 still definitively clicks the center part of spring 2, bringing contact with the circuit conductor 8. In this way, miniature devices such as a portable telephone with a good clicking sensation and improved click ratio can be realized.

The securing of sheet metal member 9 and resin sheeting 4 at the circumferential portions thereof may be made via plastic sheeting 12 applied on both surfaces with adhesive agent 11. Doing this means that in addition to the gap between protrusion part 10 and the head portion of dome shaped spring 2 remaining constant even after repeated clicks through the actuator, a switch sheet 1 with a good click ratio and a more stable structure can be obtained. With a switch sheet 1 of this type, even if the actuator causes misaligned positioning, protrusion part 10 still definitively clicks the center part of spring 2, causing conduction with circuit conductor 8. In this way, miniature devices such as a portable telephone with a good clicking sensation and improved click ratio can be realized. Further, formation of the bonding through thin plastic sheeting 12 formed of PET that has adhesive agent layer 11 on both surfaces, enables realization of a switch sheet occupying a small space and having a high degree of sensitivity.

The tip of the downward facing protrusion part 10 of sheet metal member 9 may be in contact with resin sheeting 4 covering dome shaped spring 2. This is because stable clicking can be performed when the protrusion part 10 of sheet metal member 9 is in contact with spring 2 curved over. Further, a sharp-edged sensation is obtained because there is a little idle running distance of each click. Naturally it is not necessary for protrusion part 10 to be in contact with resin sheeting 4 applied on spring 2, but this is selectable in accordance with the desired objective.

With a switch sheet according to a first embodiment of the present invention as described, when assembled into a switch, the center part of dome shaped spring 2 is definitively clicked bringing contact and conduction with circuit conductor 8 even when the actuator causes misaligned positioning. This enables miniature devices such as a portable telephone with a good clicking sensation to be realized. Further, as sheet metal member 9 having protrusion part 10 is adhered to the resin sheeting 4 through plastic sheeting 12 with adhesive agent layer 11 applied on both surfaces, thus fixed to the resin sheeting 4 by the portion 4*a* surrounding the dome shaped spring 2, a switch sheet occupying a small space with a high degree of sensitivity can be realized. Also, usage of a highly rigid sheet metal member 9 means that switch sheet 1 has a good clicking sensation, is highly durable and highly resistant to corrosion. In addition to this, production of sheet metal member 9 using pressing processes means that the sheeting can be produced using very practical methods and in a way that is advantageous from a production costs perspective also.

A second embodiment of the switch according to the invention will now be described. Generally, in a switch of the second embodiment, a switch sheet comprising a plurality of dome shaped springs with resin sheeting adhering thereto via adhesive agent, are arranged on the surface of a substrate via fixed contacts on the substrate, while thereon actuators are positioned such that they can click the center parts of the dome shaped springs and cause conduction. Specifically, in this switch the switch sheet comprises a plurality of dome shaped springs, resin sheeting adhering to the surfaces of those springs and a sheet metal member secured into position thereabove, forming one integrated body of downward facing protrusion parts formed so as to correspond to the center part of each of the dome shaped springs. With this construction miniature equipment with a good clicking sensation and an improved click ratio can be realized. This is because this construction enables the center parts of the dome shaped springs to be clicked definitively. Basically, because the sheet metal member having a plurality of downward facing protrusion parts corresponding to each dome shaped springs is formed as one integrated body, the clicking sensation felt through all of the switch parts is the same. Further, this is a switch with superior durability in relation to the number of clicks performed and wherein misalignment of the switch parts is minimized.

Figure 8:
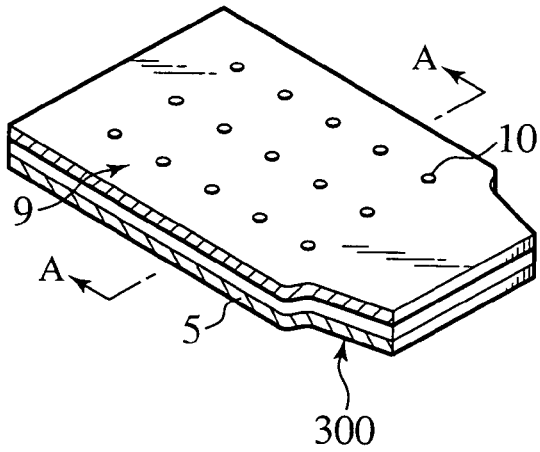
FIG. 8 is a perspective view of a second exemplary embodiment of a switch according to the present invention.
Figure 9A:
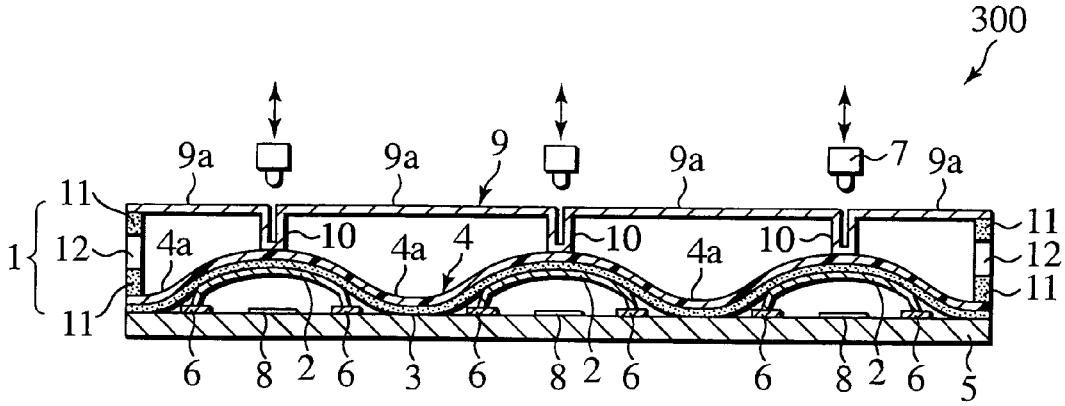
FIG. 9A is a schematic cross-sectional view along the line A—A of the switch shown in FIG. 8.

This embodiment will now be explained with reference to FIGS. 8 and 9A. FIG. 8 provides a strabismic view of switch sheet 1 developed for use in a portable telephone. FIG. 9A provides a cross-sectional view of the line A—A shown in FIG. 8. As shown in FIG. 9A, a switch 300 has a switch sheet 1 that has a plurality of dome shaped springs 2 with resin sheeting 4 adhering thereon via adhesive agent 3 are arranged on fixed contacts 6 on substrate 5. Actuators 7 are arranged on the upper part of switch sheet 1, so as to be able to click the center part of spring 2, causing conduction between fixed contact 6 and circuit conductor 8 on substrate 5. Specifically, in this switch, switch sheet 1 comprises a plurality of dome shaped springs 2, resin sheeting 4 adhered to the surfaces of those springs 2 and a sheet metal member 9 positioned thereabove. This sheet metal member 9 is formed as one integrated body providing a plurality of downward facing protrusion parts corresponding respectively to the center part of each of those springs 2. This construction enables miniature equipment with an improved click ratio and a good clicking sensitivity to be realized because it is a structure that enables the center part of a dome shaped spring to be clicked definitively. Basically, because sheet metal member 9 forms one integrated body having downward facing protrusion parts corresponding to the center part of each of the dome shaped springs, the clicking sensation felt through all of the switch parts is the same. Further, this is a switch with superior durability in relation to the number of clicks performed and wherein misalignment of the switch parts is minimized.

Further, when a switch sheet 1 having a sheet metal member 9 formed as an integrated body with downward facing protrusion parts is used in a portable telephone for example, emission of electromagnetic waves arising from the substrate 5 can be prevented by earthing the sheet metal member 9 to the substrate ground. This suppresses interference affecting externally located equipment, like loss of information or noise arising due to such electromagnetic waves.

A more detailed explanation will now be provided with reference to FIG. 9A. This kind of switch 300 is realized through using the following switch sheet 1. The switch sheet 1 is installed on fixed contact 6 of for example, printed wired substrate 5. The integrated body of sheet metal member 9 formed of thin metal sheeting is secured and arranged in position over dome shaped springs 2 to which is adhered via adhesive agent 3, resin sheeting 4 of some kind of suitable resin material. A plurality of protrusion parts 10 are formed in this sheet metal member 9 facing downwards so positioned as to correspond to each center part of the dome shaped springs 2, so that the center parts of springs 2 can be clicked by actuators 7. With a switch so constructed, the actuator 7 accurately clicks the center part of spring 2 causing conduction with circuit conductor 8.

Specifically, due to considerations of stability, thin sheeting of stainless steel of a thickness of 40 to 80 μm is used for dome shaped springs 2. Resin sheeting 4, of for example PET, adhered to the surface of springs 2, is of a thickness of 25 to 100 μm. This resin sheeting 4 adheres to dome shaped springs 2 by adhesive agent 3, with its circumferential portion fixed to fixed contacts 6 on substrate 5. There are no specific requirements for adhesive agent 3, and any substance normally so used is acceptable. Sheet metal member 9 having protrusion parts 10 formed facing downwards, disposed above the resin sheeting 4 is one integrated body formed of stainless steel of a thickness of 30 to 100 μm. This sheet metal member 9 provides protrusion parts 10 formed facing downwards positioned so as to correspond to the center part of each spring 2. In this cross-section A—A shown in FIG. 9A the sheet metal member 9 is shown to provide a series of 3 protrusion parts corresponding to dome shaped springs 2. In total, sheet metal member 9 has 15 protrusion parts 10. The diameter of a protrusion part 10 should be about 1 mm and its height should be about 0.2 mm. With this configuration, definitive clicking can be achieved even with an actuator 7 of about 1.5 to 2.0 mm of for example silicon gum or polycarbonate and there is a good clicking sensation.

Due to the rigidity of sheet metal member 9, when a click from actuator 7 is away from the center of dome shaped spring 2; protrusion part 10 definitively clicks the center part of spring 2, thereby realizing a good clicking sensation. Accordingly, a miniature device such as a portable telephone with a good click sensation and an improved click ratio can be obtained using such member in these dimensions. Further, as the circumferential portion of the integrated body of sheet metal member 9 having the protrusion parts 10 are adhered and fixed in place by thin plastic sheeting 12 of PET for example that has adhesive agent layer 11 applied on both surfaces, the switch thereby obtained occupies a small space and provides a high degree of sensitivity.

The tip of a downward facing protrusion part 10 of sheet metal member 9 may be in contact with resin sheeting 4 covering dome shaped spring 2. This means that even though dome shaped spring 2 is curved over from the center part, stable clicking can be performed as protrusion part 10 of sheet metal member 9 is in contact with spring 2. Further, a sharp-edged sensation is obtained because there is a little idle running distance of each click. Naturally it is not necessary for protrusion part 10 to be in contact with resin sheeting 4 applied on spring 2, but this is selectable in accordance with the desired objective.

A second embodiment of the switch sheet according to the invention will now be described. Generally, this switch sheet has a plurality of dome shaped springs positioned at defined intervals, resin sheeting adhered to the external surfaces of these dome shaped springs via an adhesive agent, sheet metal member positioned above the outside of this resin sheeting and having a plurality of downward facing protrusion parts formed opposing, respectively, the center part of each of the dome shaped springs. This configuration enables a switch sheet to be realized with a good clicking sensation and an improved click ratio for all of the dome shaped springs. Further, a miniature device such as a portable telephone that utilizes such a switch sheet has a superior clicking sensation.

In this embodiment, the switch sheet has dome shaped springs, resin sheeting applied, adhering to the surface of the springs, and sheet metal member positioned thereabove forming an integrated body comprising a plurality of downward facing protrusion parts corresponding, respectively, to the center part of each of the dome shaped springs. With this structure even when a dome shaped spring is miniaturized there is sufficient correlation between the protrusion parts of the sheet metal member and the dome shaped springs. This enables realization of miniature devices with an improved click ratio and a good clicking sensation because this structure enables the center part of the dome shaped springs to be clicked definitively. Basically, because the sheet metal member having protrusion parts corresponding to each of dome shaped springs forms one integrated body, the clicking sensation felt through all of the switch parts is the same. Further, this is a switch sheet with superior durability wherein misalignment of the switch parts is minimized.

Further, when a switch sheet having a sheet metal member formed as an integrated body with a downward facing protrusion part is used in a portable telephone for example, emission of electromagnetic waves arising from the substrate can be prevented by earthing the sheet metal member to the substrate ground. This suppresses interference affecting externally located equipment, like loss of information or noise arising due to such electromagnetic waves.

Figure 9B:
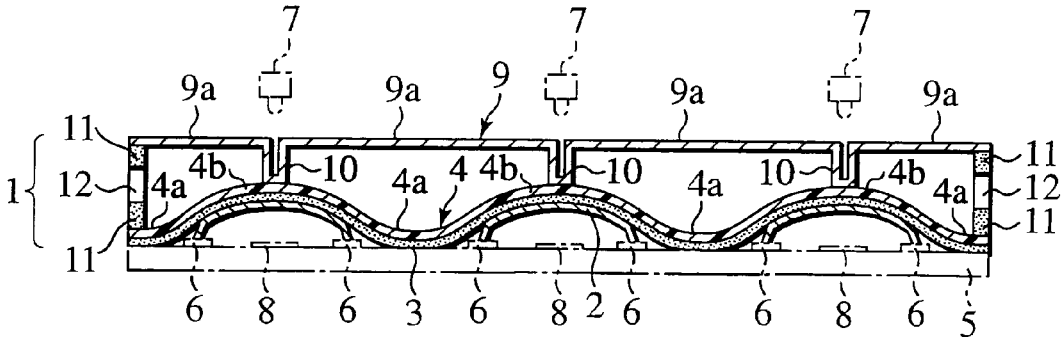
FIG. 9B is a schematic cross-sectional view of an exemplary switch sheet of the switch shown in FIG. 9A.

This embodiment will now be explained with reference to FIG. 9B. Sheet metal member 9, press processed as an integrated body, having downward facing protrusion parts are positioned to correspond respectively to the center part of each of dome shaped springs 2 is adhered and arranged to the resin sheeting 4. As described, usually, due to considerations of stability, thin sheeting of stainless steel is used for a dome shaped spring 2 of a thickness of 40 to 80 μm. PET for example, of a thickness of 25 to 100 μm is used for resin sheeting 4 applied to the surface of springs 2. Resin sheeting 4 is adhered to dome shaped springs 2 via adhesive agent 3. There are no specific requirements for this adhesive agent 3 and any material normally so used is suitable.

Sheet metal member 9 is arranged above resin sheeting 4. This sheet metal member 9 has a plurality of protrusion parts 10 formed facing downwards corresponding to each center part of the plurality of dome shaped springs 2 and is constructed of stainless steel of a thickness of 30–100 μm. The sheet metal member 9 is formed by pressing processes using one sheet of thin metal. Because sheet metal member 9 is formed from this one sheet of metal in order to provide protrusion parts corresponding to each of the plurality of dome shaped springs 2, the same clicking sensation is perceived through all of the switch parts. These switch parts have superior durability and are not susceptible to positional misalignment. Further, they provide an improved click ratio and when used in a miniaturized device, a good clicking sensation is achieved. Again, the circumferential portion of the integrated body of sheet metal member 9 having the protrusion parts 10 are adhered and fixed to the resin sheeting 4 by thin plastic sheeting 12, of PET for example, which has adhesive agent layer 11 applied on both surfaces, so the switch sheet itself occupies a small space and provides a high degree of sensitivity.

Regardless of whether this sheet metal member 9 having a plurality of downward facing protrusion parts 10 is formed as individual parts or as one integrated whole, it is, in this embodiment, formed of a highly rigid material. When sheet metal member 9 is formed using a highly rigid material, the click ratio will not deteriorate even after one million clicks because there is no change in shape of the protrusion parts in line with the increasing number of clicks performed, such as the diameter of the protrusion parts increasing and a subsequent shortening in height.

The diameter of a protrusion part of sheet metal member 9 may be of a thickness of 0.5 to 3.0 mm. When a sheet metal member 9 having protrusion parts 10 of these specifications is used, even if the click from the actuator is misaligned away from the center part of dome shaped spring 2, due to the rigidity of sheet metal member 9 protrusion part 10 clicks the center part of spring 2. Thus, a switch sheet 1 with a high click ratio and a good clicking sensation can be realized.

The cross-sectional shape of a protrusion part 10 of the sheet metal member 9 may be, pan bottomed, trapezoidal, rectangular, cylindrical, and trianglular. When so formed, a click from the actuator can produce a definitive click on the head portion of dome shaped spring 2.

In this embodiment, sheet metal member 9 has a plurality of downward facing protrusion parts 10 formed by pressing processes. This enables sheet metal member having the desired protrusion parts to be produced without requiring dies of complex shape and is advantageous from the aspect of production costs also.

A third embodiment of a switch according to the invention will now be described.

The switch of the third embodiment is a multi-directionally operable switch. Generally, this multi-directionally operable switch comprises a plurality of dome shaped springs arranged to form a basically cross shape, positioned on a wired substrate via a fixed contact and having a resin sheeting layer adhering to the surfaces thereof, a sheet metal member adhered above the dome shaped springs via plastic sheeting with adhesive agent on both surfaces, this sheet metal member forming a plurality of downward facing protrusion parts corresponding to each center part of the dome shaped springs, and an actuator positioned on the opposite side to the protrusion parts. With this construction, even if a click from the actuator is somewhat misaligned from the center part of one dome shaped spring, a protrusion part of the sheet metal member definitively clicks the center part of the dome shaped spring. A multi-directionally operable switch for a miniaturized device such as a portable telephone that has a high click ratio and a good clicking sensation is thereby obtained. Further, even if the actuator causes misaligned positioning, because a dome shaped spring can be clicked definitively, there is considerable tolerance between the positions of the actuator and multi-directionally operable switch sheet, and there are cost reductions and consequent economic benefits.

Figure 10A:
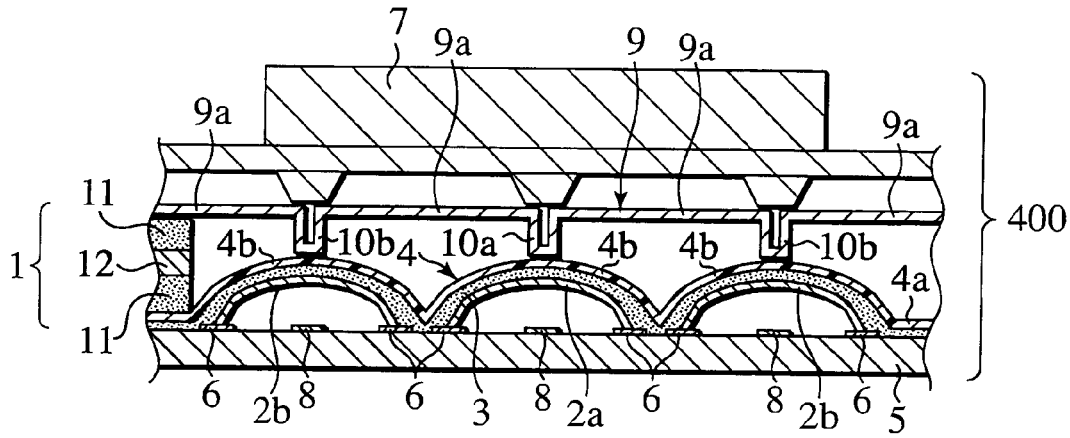
FIG. 10A is a schematic cross-sectional view of an exemplary multi-directionally operable switch according to the present invention.

More specifically, as shown in FIG. 10A, a plurality of dome shaped springs 2 (2*a* and 2*b*) with resin sheeting layer 4 applied to the surfaces thereof, are arranged in cross shape on wired substrate 5 via fixed contacts 6. Instead of the plurality of dome shaped spring 2, a metal spring having a plurality of dome shaped portions formed integrally may be used. Sheet metal member 9 forming downward facing protrusion parts 10 (10*a* and 10*b*) corresponding to each center part of dome shaped springs 2 are fixed thereabove through plastic sheeting 12 with adhesive agent on both surfaces. Actuator 7 is arranged on the opposite side to protrusion parts 10. With this multi-directionally operable switch 400 there is a high click ratio as the center part of one dome shaped spring 2 is clicked, causing contact and conduction with circuit conductor 8 and a miniature device such as a portable telephone with a good clicking sensation can be obtained. This is because this multi-directionally operable switch 400 with a structure that allows definitive clicking of the center part of dome shaped spring 2 can be used in such a device.

Figure 11:
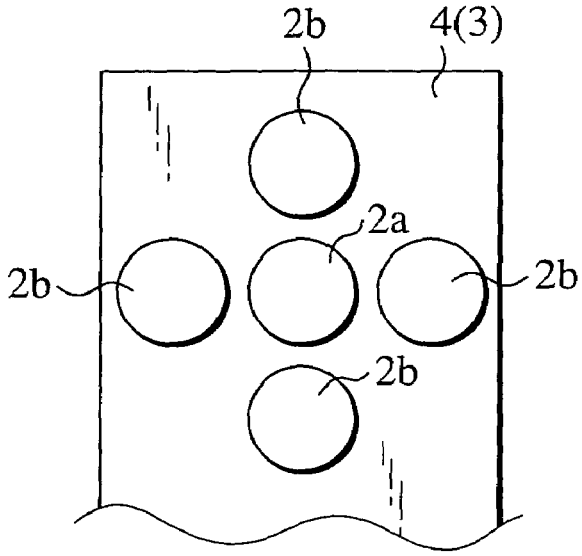
FIG. 11 is a schematic view from below of dome shaped springs arranged in a cross shaped arrangement.
Figure 12:
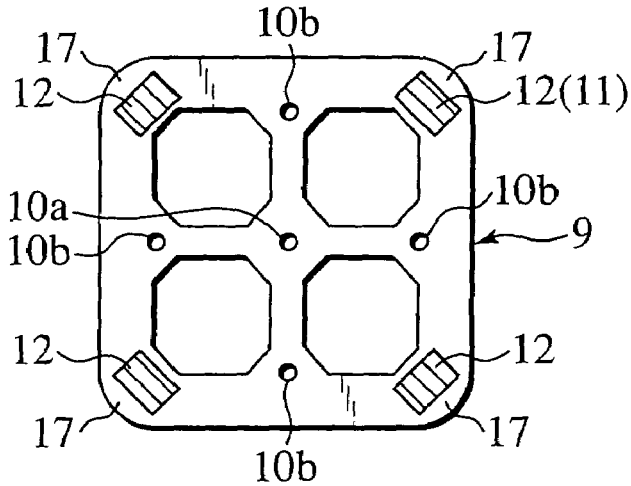
FIG. 12 is a schematic view from below of an exemplary sheet metal member in an arrangement of a square with two lines therein, one drawn horizontally and one drawn vertically so as to intersect in the center of the square.

Basically, in this embodiment, crisscross-arranged dome shaped springs 2*a* and 2*b* as shown in FIG. 11, are combined with sheet metal member 9 to form a square with two lines therein, one drawn horizontally and one drawn vertically so as to intersect in the center of the square as shown in FIG. 12. Further, this sheet metal member 9 forming such square form arrangement should be adhered and fixed to the resin sheeting 4 by 4 corner parts 17 of that square form arrangement. So constructed, in addition to realizing a multi-directionally operable switch wherein the center part of dome shaped spring 2*a* or 2*b* can be definitively clicked from actuator 7, a superior clicking sensation is realized due to flexibility of sheet metal member 9.

More specifically, normally, due to its stability, thin sheeting of stainless metal of a thickness of 40 to 80 μm is used for crisscross-arranged dome shaped springs 2*a* and 2*b*. The resin sheeting layer adhering to the surface of springs 2*a* and 2*b* is made of PET for example, of a thickness of 25 to 100 μm. Above this resin sheeting layer is installed sheet metal member 9 in an arrangement of a square with two lines therein, one drawn horizontally and one drawn vertically so as to intersect in the center of the square having protrusion parts formed facing downwards in position corresponding to each center part of the dome shaped springs. Sheet metal member 9 of the square form arrangement as described may be made of stainless steel for example, of a thickness of 30 to 100 μm, while a protrusion part 10 should have a diameter of about 1 mm and a height of about 0.2 to 1.0 mm. Thus formed, suitable click sensitivity and definitive clicking can be achieved even with an actuator 7 that is 1.5 to 2.0 mm made for example of silicone gum or polycarbonate. Further, as the above described sheet metal member is installed this multi-directionally operable switch 400 operates effectively even with a miniaturized dome shaped springs 2.

The dome shaped springs are formed of sheeting metal and has dome shaped parts formed in its center region, and has moreover, at least a pair of opposed lobes that protrudes either horizontally or in a somewhat upward direction at the external peripheral region at the bottom of each dome part. With a switch using dome shaped springs so structured, even if the springs are miniaturized such that its external diameter is 3 to 4 mm, there is not significant distortion due to shape transformation caused by clicking and durability does not deteriorate in relation to the frequency of clicks performed. Basically, even if the external diameter is 4 mm or less, no rupturing occurs after up to one million clicks where P1 load is 2.0 or greater. A switch utilizing such dome shaped springs has superior durability. Moreover, in this embodiment, the lobes are 200 μm or less high and 0.3 to 1.0 mm wide. Further, in this embodiment, for the protruding lobes, there are no burrs from the fabrication process on the side of fixed contact of wired substrate. With these dimensions there is no substantial shape distortion and consequent deterioration in durability in relation to the number of clicks made.

A third embodiment of the switch sheet according to the invention will now be described. The switch sheet of the third embodiment is multi-directionally operable switch sheet. Generally, this multi-directionally operable switch sheet comprises a plurality of dome shaped springs arranged to correspond to the directional keys and execution key of a multi-directionally operable switch, the surfaces thereof being applied with a resin sheeting layer, and sheet metal member arranged thereabove, having downward facing protrusion parts positioned so as to correspond to each center part of the dome shaped springs, circumferential portion of which sheet metal member are adhered to the sheeting layer via plastic sheeting both surfaces of which are applied with an adhesive agent. With this configuration, even if positioning misalignment occurs when the actuator performs a click, because the sheeting metal used for the sheet metal member is highly rigid, the center part of each of the dome shaped springs is clicked. Because the center part of the dome part can be clicked definitively, a multi-directionally operable switch sheet used for devices such as a portable telephone, which realizes a high click ratio and a good clicking sensation can be achieved. In addition to the cross formation described subsequently for the arrangement of the dome shaped springs, a triangular formation wherein directional keys are arranged in a form culminating in a triangular vertex or an octagonal formation wherein the directional keys are arranged culminating in an octagonal form are also conceivable.

Figure 10B:
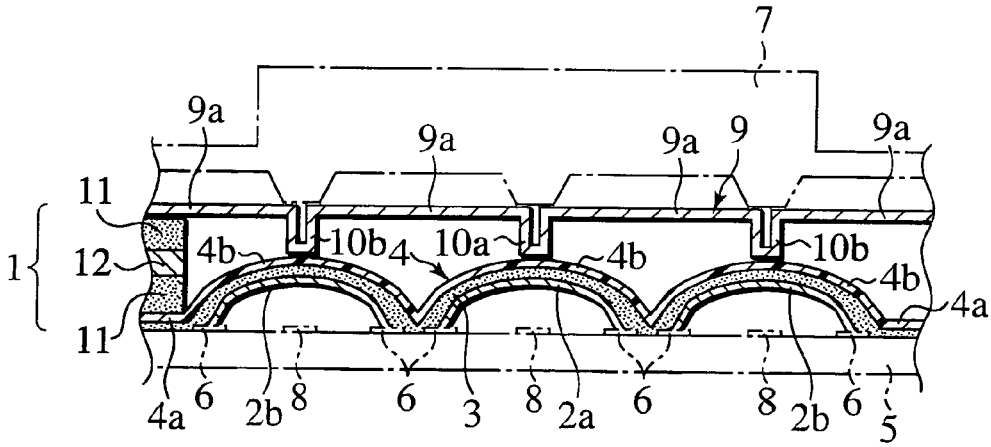
FIG. 10B is a schematic cross-sectional view of an exemplary switch sheet of the switch shown in FIG. 10A.

This embodiment will now be described with reference to FIG. 10B. Here, the multi-directionally operable switch sheet 1 is installed for example on fixed contact 6 on printed wired substrate 5. This multi-directionally operable switch sheet 1 comprises a plurality of dome shaped springs 2 the surface of which is adhered via adhesive agent 3 with resin sheeting layer 4 of for example polyethylene terephthalate, and sheet metal member 9 forming downward facing protrusion parts 10 of the same number as dome shaped springs 2, positioned so as to correspond to each center part of these dome shaped springs 2. Dome shaped springs 2 and sheet metal member 9 are secured and arranged to each other via plastic sheeting 12 that has adhesive agent 11 applied on both surfaces. The same material is used for this plastic sheeting 12 as that used for resin sheeting 4. Dome shaped springs 2 are made from thin sheeting of metal, normally stainless steel. Actuator 7 is arranged on multi-directionally operable switch sheet 1 on the opposite side to protrusion part 10 of sheet metal member 9, so as to be able to perform multi-directional clicking operations. This allows the center parts of dome shaped springs 2 to be clicked, thereby inducing conduction with circuit conductor 8 and realizing the function of multi-directionally operable switch 400.

More specifically, normally, due to its stability, thin sheeting of stainless metal of a thickness of 40 to 80 μm is used for dome shaped springs 2. Resin sheeting 4 adhered to the surface of springs 2 is made for example of polyethylene terephthalate (PET) of a thickness of 25 to 100 μm. In addition to being adhered to dome shaped springs 2 by adhesive agent 3, this resin sheeting 4 is adhered via adhesive agent 3 by the underside of the circumferential portion to wired substrate 5 in the vicinity of fixed contact 6. There are no specific requirements for adhesive agent 3, and any substance normally so used is acceptable. Sheet metal member 9 having protrusion parts 10 formed facing downwards, is formed using stainless steel for example, of a thickness of 30 to 100 μm. Sheet metal member 9 is adhered and fixed to resin sheeting layer 4 via plastic sheeting 12 both surfaces of which are applied with adhesive agent 11.

With a multi-directionally operable switch sheet 1 so constructed, in addition to actuator 7 being able to definitively click the center parts of dome shaped springs 2, a high click ratio with a good clicking sensation is still achieved even if for example, actuator 7 causes misaligned positioning. Because the center part of each dome shaped spring can be definitively clicked, there is considerable tolerance between the positions of the actuator and multi-directionally operable switch sheet, and there are cost reductions and consequent economic benefits.

A protrusion part 10 of the sheet metal member 9 may have a diameter of 1 mm and a height of 0.2 to 1.0 mm. With these dimensions a suitable click sensitivity can be achieved even with an actuator 7 that is 1.5 to 2.0 mm made for example of silicone gum or polycarbonate. This is because even if the click from actuator 7 is misaligned away from the center of each dome shaped spring 2, due to the rigidity of sheet metal member 9 protrusion part 10 clicks the center part of the dome shaped spring 2. In this way, this multi-directionally operable switch sheet 1 operates effectively even with miniaturized dome shaped springs 2. Accordingly a good clicking sensation is achievable in equipment incorporating this switch sheet.

A more suitable multi-directionally operable switch sheet can be obtained using the following configuration. In this embodiment, the dome shaped springs are arranged in basically a cross shaped arrangement, including one dome shaped spring positioned at the center of which (i.e. the intersection of the cross) and dome shaped springs positioned at the respective necessary portions of the cross. This enables the dome shaped springs of this cross shaped arrangement to function as a 4 directional directional key and execution key. For this kind of dome shaped springs also, due to considerations of stability, usually thin metal plate such as stainless steel of a thickness of 40 to 80 μm is used. The resin sheeting adhered over the surface of the springs via an adhesive agent is made of for example PET of a thickness of 25 to 100 μm. There are no specific requirements for adhesive agent 3, and any substance normally so used is acceptable. So structured, even where the diameters of the dome shaped springs are 4 mm or less the multi-directionally operable switch sheet operates effectively.

FIG. 11 shows an outline view from below of dome shaped springs 2 forming a cross shaped arrangement. Dome spring 2*a* in the center of this cross formation functions as the aforementioned execution key and the dome springs 2*b* illustrated in the vicinity of the ends of the cross in the cross formation function as directional keys. The size of the dome shaped springs 2*a* and 2*b* arranged in cross formation is about 10 mm. Above the resin sheeting layer 4 for dome shaped springs 2*a* and 2*b* is installed sheet metal member 9 with downward facing protrusion parts 10 shown in FIG. 10B, thus forming multi-directionally operable switch sheet 1. This multi-directionally operable switch sheet 1 has a high click ratio and a more stable clicking sensation is achieved. Even if the click from actuator 7 shown in FIG. 10A causes misaligned positioning away from the center region of one dome shaped spring 2*a* or 2*b*, the center part of the dome shaped spring 2*a* or 2*b* is still definitively clicked causing conduction of the circuit conductor. Thus, a miniature device such as a portable telephone with an improved click ratio and a good clicking sensation can be realized.

In this embodiment, the sheet metal member may be formed in an arrangement of a square with two lines therein, one drawn horizontally and one drawn vertically so as to intersect in the center of the square and to be combined with the crisscross-arranged dome shaped springs 2*a* and 2*b*. So constructed multi-directionally operable switch sheet 1 operates effectively even when the dome shaped springs are miniaturized and the center region of each dome shaped spring can be definitively clicked. Further, this enables equipment such as a portable telephone with an improved click ratio and a good clicking sensation to be realized. Because in a multi-directionally operable switch according to the prior art the dome shaped springs are arranged in proximity, with purely sheet metal member the structure is more rigid creating a deterioration in the clicking sensation, and a neighboring dome shaped spring different to the clicked one can be depressed as well. Where however the sheet metal member forms a square like formation as described above, the appropriate degree of rigidity is maintained and a multi-directionally operable switch sheet with a good clicking sensation can be realized. Further, as the center part of the dome shaped spring can be definitively clicked there is considerable tolerance between the positions of the actuator and multi-directionally operable switch sheet, and there are cost reductions and consequent economic benefits.

FIG. 12 is an outline view from the direction where protrusion parts 10*a* and 10*b* are formed on sheet metal member 9 that is in an arrangement of a square with two lines therein, one drawn horizontally and one drawn vertically so as to intersect in the center of the square. Protrusion parts 10*a* and 10*b* are arranged so as to correspond with crisscross-arranged dome shaped springs 2*a* and 2*b*. Protrusion parts 10*a* and 10*b* and dome shaped springs 2*a* and 2*b* are adhered to resin sheeting layer 4 via plastic sheeting 12 that has adhesive agent 11 applied on both surfaces, as shown in FIG. 10B. With these parts secured in this way, a multi-directionally operable switch that occupies a small space and has a high degree of sensitivity can be realized.

Usually, sheet metal member 9 arranged as a square with two lines therein, one drawn horizontally and one drawn vertically so as to intersect in the center of the square, which provides protrusion parts 10*a* and 10*b* formed facing downwards, is made from stainless steel of a thickness of 30 to 100 μm. The protrusion parts 10*a* and 10*b* may have a diameter of 1 mm and a height of 0.2 mm. With these dimensions a suitable click sensitivity can be achieved even using actuator 7 that is 1.5 to 2.0 mm made for example of silicone gum or polycarbonate. This is because, even when a click from actuator 7 is misaligned away from the center of dome shaped spring 2*a* or 2*b*, protrusion part 10*a* or 10*b* definitively clicks the center part of dome shaped spring 2*a* or 2*b*. A multi-directionally operable switch utilizing this multi-directionally operable switch sheet is suitable for use in miniaturized equipment such as a portable telephone as it provides a high click ratio and a good clicking sensation even when the actuator causes misaligned positioning.

In this embodiment, sheet metal member 9 may be arranged as a square with two lines therein, one drawn horizontally and one drawn vertically so as to intersect in the center of the square be adhered and secured to dome shaped springs 2*a* and 2*b* only at the four corners of that square formation through plastic sheeting 12 that has adhesive agent on both surfaces. This produces a suitable flexibility of sheet metal member 9, improving the clicking sensation. Basically, sheet metal member 9 of the above described square arrangement is adhered and fixed to crisscross-arranged dome shaped springs 2*a* and 2*b* via plastic sheeting 12 that has adhesive agent on both surfaces, only on its 4 corner portions indicated as 17 in FIG. 12. This is because if sheet metal member 9 in the squared arrangement as described were to be adhered and fixed to dome shaped springs 2*a* and 2*b* via the greater part of its peripheral portions, flexibility of member 9 would deteriorate, producing a poorer clicking sensation.

The effects of this intervention will now be described with reference to its embodiments.

Embodiment 1

Figure 2A:
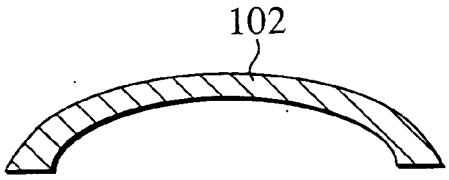
FIG.2A PRIOR ART
FIG. 2A and FIG. 2B are schematic cross-sectional views of dome shaped springs utilized in switch sheets according to the prior art.

For embodiment 1 a switch was produced using a switch sheet described following, and the click ratio was then measured. A switch sheet structured as shown in FIG. 4A was produced as follows. Dome shaped spring 2 formed of stainless steel sheeting of a thickness of 0.05 mm as shown in FIG. 2A was arranged on flexible printed wired substrate 5. Sheeting 4 of polyethylene terephthalate 50 μm thick was adhered to the surface of spring 2 by acrylic adhesive agent 3, 40 μm thick. Stainless steel sheeting 50 μm thick was used to produce sheet metal member 9 that has downward facing protrusion part 10 that is 0.15 mm high with a diameter across of 1.0 mm formed to correspond to the center of dome shaped spring 2. Above sheeting 4, sheet metal member 9 was fixed, adhered by its circumferential portion using sheeting 12 of polyethylene terephthalate 200 μm thick that had adhesive agent applied on both surfaces. A switch 200 using this switch sheet 1 was produced and the click ratio was measured by measuring pressing load using an actuator of 2 mm ϕ in size. The click ratio was calculated from values obtained by measuring the maximum load and the load when the dome shaped spring 2 touched the contact. The results are shown in FIG. 13A.

Figure 1:
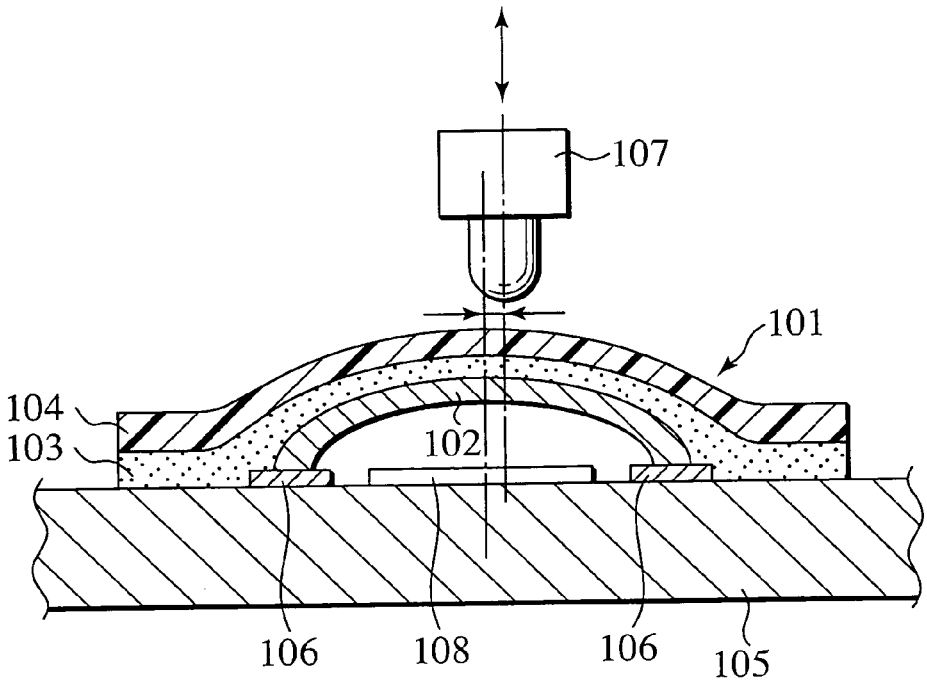
FIG.1 PRIOR ART
FIG. 1 is a schematic cross-sectional view of a switch according to the prior art.
Figure 2B:
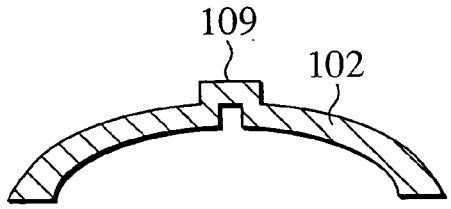
FIG.2B PRIOR ART
Figure 3:
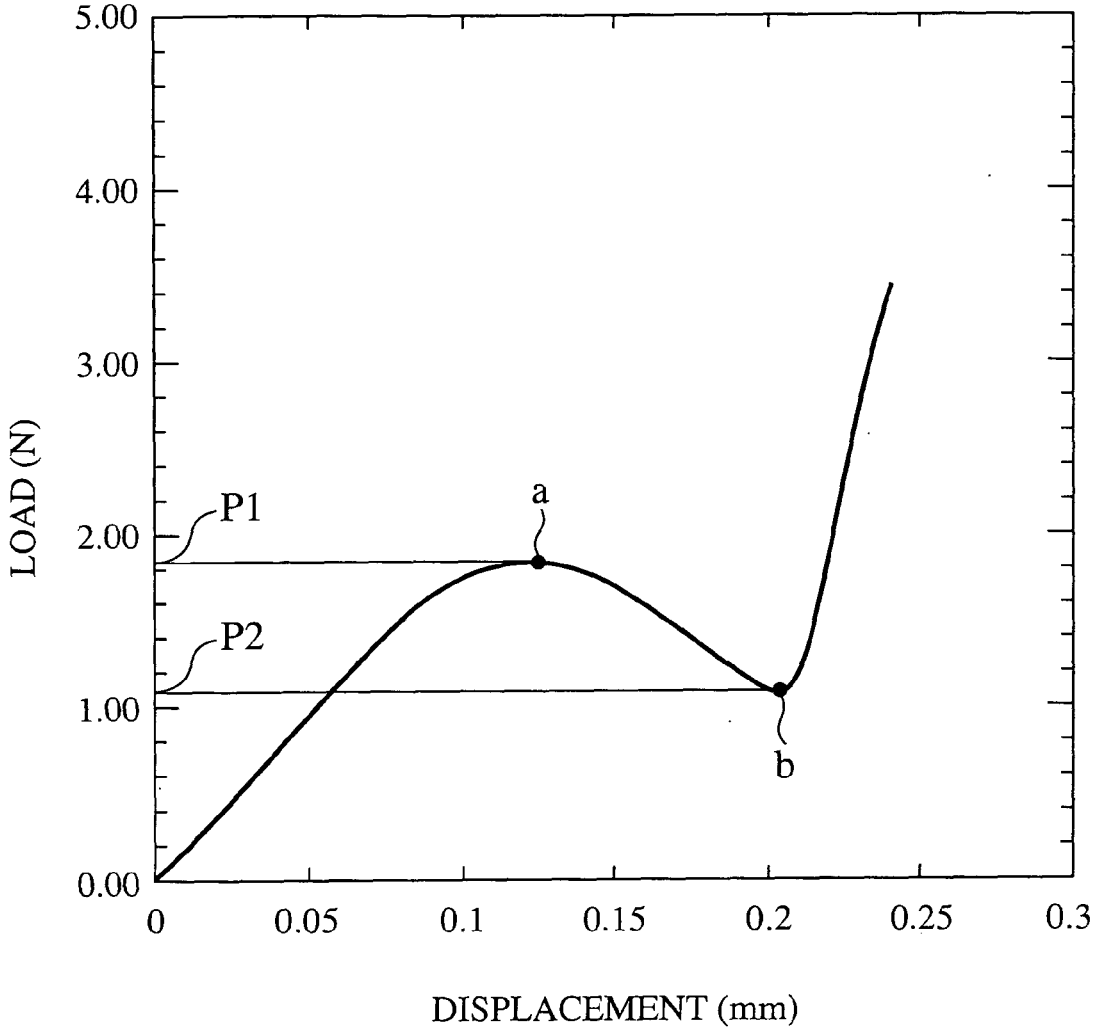
FIG.3 PRIOR ART
FIG. 3 is a graph showing load-displacement curve for a dome shaped spring of the prior art.

The switch structured as shown in FIG. 1 was produced to provide a comparative example. In other words, dome shaped springs of the form shown in FIG. 2A and FIG. 2B were formed using stainless steel sheeting. Switch sheets using these dome shaped springs were produced having exactly the same dimensions as the switch sheet of embodiment 1. The protrusion 109 of the dome shaped spring shown in FIG. 2B has a height of 0.025 mm and a diameter of 0.6 mm. The switch sheet of this comparative example was assembled into a switch in the same way as the assembly for embodiment 1 and the click ratios of these examples were measured by performing the same test. The results obtained using the dome shaped spring shown in FIG. 2A are shown in FIG. 13B and the results for the dome shaped spring shown in FIG. 2B are shown in FIG. 13C.

Figure 13A:
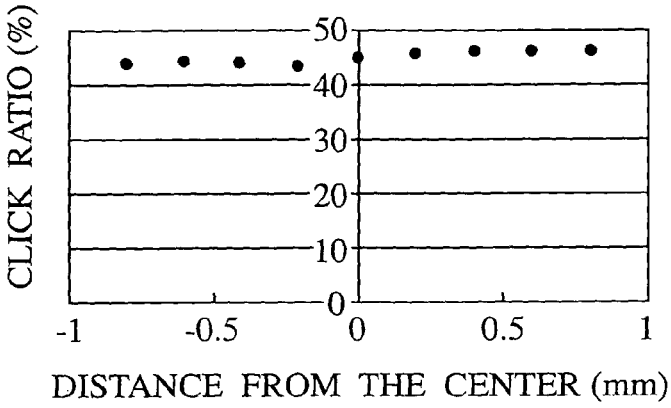
FIG. 13A is a graph showing the result of an experiment measuring the first exemplary embodiment according to the present invention.
Figure 13B:
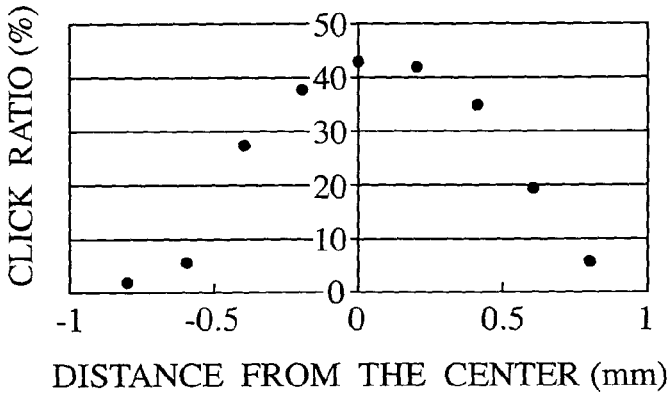
FIGS. 13B and 13C are graphs showing the results of experimentation with comparative examples.
Figure 13C:
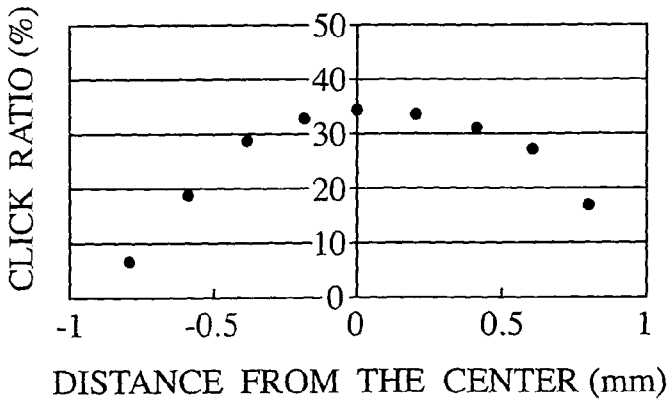

As is clear from FIGS. 13A, 13B and 13C, the best results are the ones shown in the graph of FIG. 13A showing the results derived from embodiment 1. That is to say, regardless of the position of the click, the click ratio achieves a value of 40% or greater. Further, that click ratio remains constant regardless of the distance from the center (the distance from the center part of the dome shaped spring that is clicked). This is significantly different from the results obtained for the comparative examples shown in FIGS. 13B and 13C. In other words, in both those examples, there was a corresponding deterioration in the click ratio in relation to the distance from the center to the point that the click is performed, indicating that definitive clicking was not achieved. Thus, arranging sheet metal member having a protrusion part of a specified height facing downwards from above corresponding to the central position of a dome shaped spring as described according to the present invention, enables definitive clicking to be performed from the actuator, thereby realizing a superior switch sheet and switch having a good clicking sensation.

Embodiment 2

For embodiment 2 a switch sheet described following was produced and the click ratio measured. Measurement of the click ratio was conducted in the same manner as for embodiment 1, by calculating the ratio from values obtained by measuring the maximum load and the load when the dome shaped spring touched the contact. Basically, the switch sheet for this embodiment was formed as follows. Dome shaped springs 2 of stainless steel sheeting 0.05 mm thick were arranged on fixed contact 6 of printed wired substrate 5 used for a portable telephone. The dome part of this dome shaped spring 2 had a height of about 0.2 mm. Resin sheeting 4 of polyethylene terephthalate 50 μm thick was adhered thereon by acrylic adhesive agent 3, which was 40 μm thick. Stainless steel sheeting 50 μm thick was used to produce, by pressing processes, sheet metal member 9 that forms in one integrated body, downward facing protrusion parts 10 that are 0.15 mm high with a diameter across of 1.0 mm, corresponding to each center of the dome shaped springs 2. Here, there are 15 protrusion parts formed by the sheet metal member 9. Above resin sheeting 4, sheet metal member 9 was fixed, adhered by its circumferential portion using sheeting 12 of polyethylene terephthalate 200 μm thick that had adhesive agent applied on both surfaces.

The results of the test showed a click ratio achieving a value of 40% or greater. Moreover, that click ratio remains constant regardless of the distance from the center (the distance from the center part of the dome shaped spring that is clicked). Further, thus arranging sheet metal member 9 providing one integrated body forming protrusion parts 10 means that the same clicking sensation is obtained by all the switch parts, and superior durability is achieved withstanding 3 million clicks or more. This indicates that embodiment 2 provides a superior switch sheet wherein clicking from the actuator is definitively performed and which has a good clicking sensation.

Embodiment 3

For embodiment 3 a multi-directionally operable switch 400 was produced and the click ratio of the execution key (the center key) and the directional keys (the side keys) was measured. This multi-directionally operable switch 400 possesses the structure as shown in FIG. 10A, formed by pressing processes and comprising dome shaped springs 2*a* and 2*b* forming a cross shaped arrangement as shown in FIG. 11 arranged on flexible printed wired substrate 5 and sheet metal member 9 in an arrangement as shown in FIG. 12 of a square with two lines therein, one drawn horizontally and one drawn vertically so as to intersect in the center of the square. More specifically, crisscross-arranged dome shaped springs 2*a* and 2*b* were formed of stainless steel sheeting 0.05 mm thick and had resin sheeting 4 of polyethylene terephthalate 50 μm thick adhered on its surface by acrylic adhesive agent 3, which was 40 μm thick. Above the resin sheeting 4 was arranged sheet metal member 9 of the above described square shaped formation, providing downward facing protrusion parts 10, 0.15 mm high with a diameter across of 1.0 mm, formed corresponding to each center of dome shaped springs 2*a* and 2*b*. Sheet metal member 9 was adhered and fixed to the resin sheeting 4 by its 4 corner parts 17 using plastic sheeting 12 of polyethylene terephthalate 20 μm thick both surfaces of which were applied with adhesive agent layer 11. The height of the dome parts of crisscross-arranged dome shaped springs 2*a* and 2*b* were about 0.2 mm. An actuator with a diameter of 2 mm was arranged above the multi-directionally operable switch sheet 1 so constructed, thereby forming multi-directionally operable switch 400.

Next, this multi-directionally operable switch 400 was used and the click ratio was measured by measuring pressing load. The click ratio was calculated from values obtained by measuring the maximum load and the load when the center key and side keys of dome shaped spring 2 touched the contact. The results are shown in FIG. 14 marked with a circle, O.

To provide a comparative example, a multi-directionally operable switch according to the prior art was produced using dome shaped springs of the form shown in FIG. 2B. The dimensions of the respective parts of this structure were exactly the same as those for the structure used for embodiment 3. The protrusion of the dome shaped springs had a height of 0.025 mm and a diameter of 0.6 mm. In the same manner as the tests conducted for embodiment 3, the click ratios for the center key and side keys of this multi-directionally operable switch were measured. The results are shown in FIG. 14 marked with a black circle, •.

Figure 14:
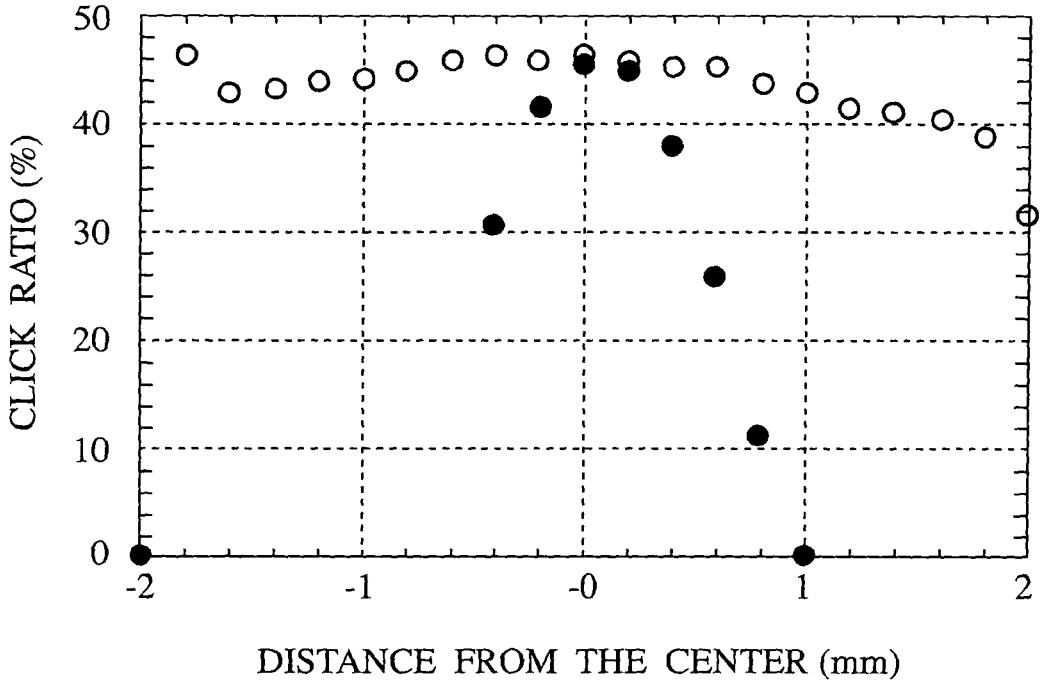
FIG. 14 is a graph showing the click ratio for a center key and for side keys.

As is clear from the graph in FIG. 14, embodiment 3 has a high and stable click ratio. In contrast to this the black circles on the graph clearly indicate that for both the center key and side keys of the multi-directionally operable switch used for the comparative example there was substantial variation in the click ratio and a poor clicking sensation when the dome shaped spring was clicked out of position from the center. More specifically, for embodiment 3, there was a stable click ratio of 40% measured for both the center key and the side keys from clicks made in a comparatively broad area away from the center of the dome. This click ratio shows that a good clicking sensation is achieved. This indicates that sheet metal member 9 providing protrusion parts and in an arrangement of a square with two lines therein, one drawn horizontally and one drawn vertically so as to intersect in the center of the square is remarkably effective. That is to say, embodiment 3 provides a superior switch sheet and switch enabling definitive clicking to be performed from the actuator, and having a good clicking sensation. In contrast to this, when the multi-directionally operable switch constructed according to the prior art was tested, there was a comparatively low click ratio for both the center key and the side keys when the click occurred away from the center region of the dome. This shows that definitive clicking did not take place and there was not a good clicking sensation.

As described embodiments of a switch sheet according to the present invention and switch according to those embodiments utilizing such switch sheet have the following characteristics and effects.

Therein, switch sheet 1 comprises a dome shaped spring 2 having external surface on convex side; resin sheeting 4 having first and second surfaces and adhered to the external surface of said dome shaped spring 2 by the first surface; and a sheet metal member 9 positioned above the second surface of said resin sheeting 4, having a downward facing protrusion part 10 formed opposing the center part of said dome shaped spring 2.

A circumferential portion of the sheet metal member 9 is adhered to said resin sheeting 4 through plastic sheeting 12.

Alternatively, switch sheet 1 comprises a plurality of dome shaped springs 2 positioned at defined intervals and having external surface on convex side; resin sheeting 4 having first and second surfaces and adhered to the external surfaces of said dome shaped springs 2 by the first surface; and a sheet metal member 9 arranged above the second surface of said resin sheeting 4, having a plurality of downward facing protrusion parts 10, each protrusion part 10 being formed opposing each center part of said dome shaped springs 2.

Alternatively, switch sheet 1 comprises resin sheeting 4 having first and second surfaces; a dome shaped spring 2 having a convex surface that is adhered to the first surface of said resin sheeting 4 by substantial entirety of the convex surface, the dome shaped spring 2 having a rotationally symmetrical axis; and a sheet metal member 9 provided above the second surface of said resin sheeting 4 through plastic sheeting, wherein said resin sheeting 4 has a flat portion 4*a* surrounding a part that adhered to said dome shaped spring 2, said sheet metal member 9 has a cylindrically shaped protrusion part 10 that protrudes toward said dome shaped spring 2, an axis of the cylindrically shaped protrusion part 10 being aligned with the rotationally symmetrical axis of said dome shaped spring 2, and said sheet metal member 9 is secured to the flat portion 4*a* of said resin sheeting 4 by circumferential portion of said protrusion part 10.

This switch sheet operates effectively even when dome shaped spring 2 is miniaturized as the approximate center part of that spring 2 can be clicked definitively. Further, in addition to being highly durable and long lasting, this switch sheet enables miniaturized equipment with an improved click ratio and a good clicking sensation to be realized. Accordingly, the user of such equipment can distinctly perceive the clicking of the switch with their fingers.

The resin sheeting 4 extends outwardly beyond the external periphery of said dome shaped spring 2. Both circumferential portions of said sheet metal member 9 and said resin sheeting 4 are secured to each other. So configured, even when clicking from the actuator is repeated over and over, positional misalignment of protrusion part 10 away from the center part of dome shaped spring 2 does not occur and a switch sheet with a stable structure and high click ratio is obtained. In this embodiment, circumferential portions of said sheet metal member 9 and said resin sheeting 4 may be secured via plastic sheeting 12. So configured, even when clicking from the actuator is repeated over and over, the space between protrusion part 10 and the head part of the dome of dome shaped spring 2 is maintained constant, and a switch sheet with a stable structure and good click ratio can be obtained.

With this switch sheet 1, even if the actuator causes positional misalignment, the center part of dome shaped spring 2 is still definitively clicked, causing conduction with circuit conductor 8. In this way, miniature devices such as a portable telephone with a good clicking sensation and improved click ratio can be realized. Further, adhering and fixing of sheet metal member 9 and resin sheeting 4 through thin plastic sheeting 12 formed of PET that has adhesive agent layer 11 on both surfaces, enables realization of a switch sheet occupying a small space and having a high degree of sensitivity.

The tip of said downward facing protrusion part 10 of said sheet metal member 9 is in contact with said resin sheeting 4 covering said dome shaped spring 2. Because the center part of spring 2 is curved over protrusion part 10 of sheet metal member 9 is in contact with spring 2 and stable clicking can be performed. Further, a good cutoff sensation is obtained because there is no distance of empty space covered with each click.

The sheet metal member 9 is formed of a rigid material. With a sheet metal member formed of stainless steel for example there is basically no deterioration in the click ratio even after one million clicks are performed. The downward facing protrusion part 10 has a cylindrical shape, and the diameter of the downward facing protrusion part 10 is between 0.5 and 3.0 mm. Thus, even if the click from the actuator is misaligned away from the center part of dome shaped spring 2, due to the rigidity of sheet metal member 9 protrusion part 10 can click the center part of dome shaped spring 2, thus enabling a switch sheet with a high click ratio and a good clicking sensation to be realized.

The shape of the protrusion part 10 of said sheet metal member 9 is cross-sectionally, pan bottomed, trapezoid, rectangular, cylindrical or triangle. This form enables the head part of the dome of dome shaped spring 2 to be clicked definitively after a click from the actuator. The sheet metal member 9 is formed by sheet metal pressing processes, therefore there are benefits from the aspect of production costs and a practical switch sheet 1 is obtained.

Alternatively, switch sheet 1 is a switch sheet for a multi-directionally operable switch having an execution key and directional keys, and comprises a plurality of dome shaped springs 2 positioned to correspond to the execution key and directional keys, having convex surface; resin sheeting 4 having first and second surfaces and adhering to the convex surfaces of said dome shaped springs 2 by the first surface; and a sheet metal member 9 positioned above the second surface of said resin sheeting 4, having a plurality of downward facing protrusion parts 10, each protrusion part 10 being formed in position so as to correspond to each center part of said dome shaped springs 2, circumferential portion of the sheet metal member 9 being adhered to said resin sheeting 4 via plastic sheeting 12. So constructed, even if positioning misalignment is caused by the clicking of the actuator, due to the rigidity of sheet metal member 9 the center part of each of dome shaped springs 2 is clicked definitively. Thus, definitive clicking is still achieved so a multi-directionally operable switch sheet with a high click ratio and having a good clicking sensation can be provided. Basically, even when such positional misalignment occurs the click ratio is still 40% or greater. Accordingly, tolerance between the positions of the actuator and multi-directionally operable switch sheet is considerable, there are cost reductions and consequent economic benefits.

The protrusion part 10 of the sheet metal member 9 has a diameter of 1 mm and a height of 0.2 to 1.0 mm. So constructed, a suitable click sensitivity can be achieved even with an actuator that is 1.5 to 2.0 mm made for example of silicone gum or polycarbonate. This multi-directionally operable switch sheet 1 operates effectively even with a miniaturized dome shaped spring 2, enabling miniaturized devices such as a portable telephone with a high click ratio and good clicking sensation to be realized.

The dome shaped springs 2 are arranged to form a basically cross shape, including a dome shaped spring 2*a* positioned at the center of said cross shaped form and dome shaped springs 2*b* positioned at prescribed locations in four directions from the center. Accordingly in addition to realizing the above described effects, the switch parts can function effectively for directional keys and an execution key when clicked in the direction of either the cross shaped formation or in the center of the cross. Further, the sheet metal member 9 forms an arrangement of a square with two lines therein, one drawn horizontally and one drawn vertically so as to intersect in the center of the square. With this construction a multi-directionally operable switch sheet having a high click ratio and a more stable clicking sensation can be achieved. With this kind of multi-directionally operable switch sheet, the center part of each of dome shaped springs is still clicked definitively even if positional misalignment is caused by the click from the actuator, making this multi-directionally operable switch sheet suitable for a miniature device such as a portable telephone by providing a high click ratio and a good clicking sensation.

The sheet metal member 9 forming an arrangement of a square with two lines therein, one drawn horizontally and one drawn vertically so as to intersect in the center of the square is adhered to said dome shaped springs only at the four corners of said arrangement of a square with two lines therein, one drawn horizontally and one drawn vertically so as to intersect in the center of the square, via said plastic sheeting 12. This provides a multi-directionally operable switch sheet with a high click ratio and stable clicking sensation wherein even if positional misalignment is caused by the click from the actuator the center part of each of dome shaped springs is clicked definitively. Accordingly a miniature device such as a portable telephone with an improved click ratio and good clicking sensation can be realized.

In the above described construction, sheet metal member 9 is sufficiently rigid and has the appropriate flexibility thereby providing an improved click ratio. Further this construction is suitable even where the dome shaped spring is miniaturized. A multi-directionally operable switch sheet fully conforming to the above described construction realizes the desired effects more comprehensively.

So constructed, even when dome shaped spring 2 is miniaturized there is sufficient correlation between protrusion parts 10 of sheet metal member 9 and dome shaped springs 2. This enables realization of miniature devices with an improved click ratio and a good clicking sensation.

Switch comprises a substrate 5 having a fixed contact 6 and a conducting circuit 8 arranged thereon; a dome shaped spring 2 positioned on the upper surface of said substrate 5 via the fixed contact 6; resin sheeting 4 adhering to the upper surface of said dome shaped spring 2 and the upper surface of said substrate 5; a sheet metal member 9 secured and positioned above the resin sheeting 4 through a supporting member 12, said sheet metal member 9 having a downward facing protrusion part 10 formed in the position corresponding to the center part of said dome shaped spring 2; and an actuator 7 positioned above said sheet metal member 9 such that it can click the center part of said dome shaped spring 2 via said sheet metal member 9 to enable conduction. With this construction, the actuator can definitively click the center part of dome shaped spring 2 making it contact with circuit conductor 8, thereby causing definitive conduction between fixed contact 6 and circuit conductor 8. Further, this enables electronic equipment with an improved click ratio and a good clicking sensation suitable for a miniaturized device to be realized and it provides superior durability in relation to the frequency of clicking operations performed.

Alternatively, switch comprises a substrate 5 having a fixed contact 6 and a conducting circuit 8 arranged thereon; a plurality of dome shaped spring 2 positioned on the upper surface of the substrate 5 via the fixed contact 6; resin sheeting 4 adhering to the upper surfaces of said dome shaped springs 2 and the upper surface of said substrate 5; a sheet metal member 9 positioned above said resin sheeting 4 through a supporting member 12, having a plurality of downward facing protrusion parts 10 corresponding, respectively, to each center part of said dome shaped springs 2; and an actuator 7 positioned above said sheet metal member 9 such that it can click the center part of said dome shaped spring 2 via said sheet metal member 9 to enable conduction. With this construction a miniaturized device with an improved click ratio and a good clicking sensation can be obtained. This is because this structure enables the center part of each of dome shaped springs 2 to be clicked definitively. Basically, as sheet metal member 9 forms one integrated body having downward facing protrusion parts 10 corresponding respectively, to the center part of each of the dome shaped springs 2, the clicking sensation felt through all of the switch parts is the same and there is superior durability in relation to the frequency of clicking operations performed. Further positional misalignment of the switch parts is reduced.

Moreover, if this switch is used in a portable telephone for example, having sheet metal member 9 formed as an integrated body with downward facing protrusion parts 10, means that emission of electromagnetic waves arising from substrate 5 can be prevented by earthing sheet metal member 9 to substrate 5 ground. This suppresses interference affecting externally located equipment, like loss of information or noise arising due to such electromagnetic waves.

Alternatively, switch comprises a substrate 5 having a fixed contact 6 and a conducting circuit 8 arranged thereon; a dome shaped spring 2 having a rotationally symmetrical axis, and arranged on said substrate 5 such that the external periphery thereof contacts said fixed contact 6 and said conducting circuit 8 is below the rotationally symmetrical axis; resin sheeting 4 adhered to the upper surface of said dome shaped spring 2 and the upper surface of said substrate 5; a sheet metal member 9 arranged above said resin sheeting 4 through a supporting member 12; and an actuator 7 positioned above said sheet metal member 9 substantially along said rotationally symmetrical axis, such that if moved in a downward direction said dome shaped spring 2 is depressed via said sheet metal member 9 to contact said conducting circuit 8, wherein said resin sheeting 4 has a flat portion 4*a* that adhered to said upper surface of said substrate 5, said sheet metal member 9 has a cylindrically shaped protrusion part 10 that protrudes toward said dome shaped spring 2, an axis of the cylindrically shaped protrusion part 10 is aligned with the rotationally symmetrical axis of said dome shaped spring 2, and said sheet metal member 9 is secured to said flat portion 4*a* of said resin sheeting 4 at the circumferential part of said protrusion part 10.

Alternatively, switch comprises a printed wired substrate 5 having a fixed contact 6 and a conducting circuit 8 arranged thereon; a plurality of dome shaped springs 2 arranged to form a basically cross shape, positioned on said printed wired substrate 5 via the fixed contact 6 and having a resin sheeting 4 adhering to the upper surfaces thereof, a sheet metal member 9 adhered above the dome shaped springs 2 through plastic sheeting 12, said sheet metal member 9 having a plurality of downward facing protrusion parts 10, each protrusion part 10 formed to correspond to each center part of said dome shaped springs 2, and an actuator 7 positioned on the opposite side of said protrusion parts 10.

This switch is suitable as a multi-directionally operable switch for a miniaturized device such as a portable telephone providing a high click ratio and good clicking sensation. That is to say, the center part of a dome shaped spring 2 is definitively clicked from the actuator 7, and as the clicking sensation provided is superior due to flexibility of the sheet metal member 9, this multi-directionally operable switch is superior. Further, as definitive clicking can be achieved even with an actuator 7 that is 1.5 to 2.0 mm this multi-directionally operable switch operates effectively even with a miniaturized dome shaped spring 2. Basically, it realizes a click ratio of 40% or more thus providing a good clicking sensation. Moreover, the clicking sensation felt through all of the switch parts of dome shaped springs 2 is the same.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A switch sheet comprising:

a spring member;

a resin sheet supported by an external surface of said spring member; and a substantially rigid member positioned adjacent to said resin sheet, comprising a protrusion part protruding towards a center part of said spring member wherein said substantially rigid member is supported by a side of said resin sheet facing the protrusion part.

2. A switch sheet comprising:

a spring member;

a resin sheet supported by an external surface of said spring member; and a substantially rigid member, which is substantially planar, positioned adjacent to said resin sheet, comprising:

a protrusion part protruding towards a center part of said spring member, and a circumferential portion adhered to a side of said resin sheet facing the protrusion part.

3. A switch sheet comprising:

a plurality of spring members positioned at defined intervals;

a resin sheet supported by external surfaces of said spring members; and a substantially rigid member positioned adjacent to said resin sheet, comprising a plurality of protrusion parts, each of the protrusion parts protruding toward center parts of each of said spring members, wherein said substantially rigid member is supported by a side of said resin sheet facing the plurality of protrusion parts.

4. A switch sheet comprising:

a resin sheet;

a spring member supporting said resin sheet on an external side, said spring member comprising a rotationally symmetrical axis; and a substantially rigid member provided adjacent to said resin sheet, wherein:

said substantially rigid member is substantially planar;

said resin sheet comprises a flat portion surrounding a part that is supported by said spring member;

said substantially rigid member further comprises a protrusion part that protrudes toward said spring member and a circumferential portion that is secured to said flat portion of said resin sheetfacing the protrusion part; and an axis along a direction of extension of said protrusion part is aligned with said rotationally symmetrical axis of said spring member.

5. A switch sheet according to claim 4, wherein said spring member is generally dome-shaped.

6. A switch sheet according to claim 5, wherein said external surface of said spring member is a convex side of said dome-shape.

7. A switch sheet according to claim 4, wherein said protrusion part protrudes substantially orthogonally from said substantially rigid member.

8. A switch sheet according to claim 4, wherein said resin sheet substantially covers said spring member.

9. A switch sheet according to claim 4, wherein said resin sheet extends outwardly beyond an external periphery of said spring member.

10. A switch sheet according to claim 4, wherein a circumferential portion of said substantially rigid member and said resin sheet are secured to each other.

11. A switch sheet according to claim 4, wherein a circumferential portion of said substantially rigid member and said resin sheet are secured to each other via an interposed plastic sheet.

12. A switch sheet according to claim 4, wherein said protrusion part is in contact with said resin sheet.

13. A switch sheet according to claim 4, wherein said substantially rigid member is made of sheet metal.

14. A switch sheet according to claim 13 wherein said substantially rigid member of sheet metal is shaped to be formed by a sheet metal pressing process.

15. A switch sheet according to claim 4, wherein said protrusion part comprises a generally cylindrical shape with a diameter between 0.5 and 3.0 mm.

16. A switch sheet according to claim 4, wherein a cross-sectional shape of said protrusion part is, pan bottomed, trapezoidal, rectangular, cylindrical or triangular.

17. A switch sheet according to claim 4, wherein said protrusion part is spaced apart from said resin sheet by a predetermined distance.

18. A switch sheet according to claim 4, wherein said resin sheet is adhered to said spring member by an adhesive.

19. A switch sheet according to claim 4, wherein said rigid member has a Young's Modulus of 70–200 GPa.

20. A switch sheet according to claim 4, wherein said rigid member is made of stainless steel.

21. A switch sheet for a multi-directionally operable switch having an execution key and a directional key, comprising:

a plurality of spring members positioned to correspond to said execution key and said directional key;

a resin sheet supported by external surfaces of said spring members; and a substantially rigid member, which is substantially planar, positioned adjacent to said resin sheet, comprising:

a plurality of protrusion parts, each protrusion part being formed in position so as to correspond to each center part of said spring members; and a circumferential portion connected to said resin sheet.

22. A switch sheet according to claim 21 wherein said spring members are generally arranged in a cross shape, wherein one of said spring members is positioned at a center of said cross shape and others of said spring members are positioned at prescribed locations in four directions from said center.

23. A switch sheet according to claim 22 wherein said substantially rigid member forms an arrangement of a square with two lines therein, said two lines are perpendicular to each other and intersect in a center of said square.

24. A switch sheet according to claim 23 wherein said substantially rigid member is connected to said resin sheet only at four corners of said arrangement of a square with two lines therein, and has a plastic sheeting arranged therebetween.

25. A switch sheet according to claim 21, wherein the circumferential portion of the substantially rigid member is connected to a side of said resin sheet facing the protrusion part.

26. A switch sheet according to claim 21, wherein said rigid member has a Young's Modulus of 70–200 GPa.

27. A switch sheet according to claim 21, wherein said rigid member is made of stainless steel.

28. A switch comprising:

a substrate comprising a fixed contact and a conducting circuit arranged thereon;

a spring member positioned on a surface of said substrate via said fixed contact;

a resin sheet supported by an external surface of said spring member and said surface of said substrate;

a substantially rigid member, which is substantially planar, positioned adjacent to said resin sheet and supported by a supporting member, comprising a protrusion part protruding towards a center part of said spring member; and an actuator positioned adjacent to said substantially rigid member such that the actuator can depress said center part of said spring member via said substantially rigid member to enable conduction.

29. A switch according to claim 28, wherein a circumferential portion of the substantially rigid member is adhered to a side of said resin sheet facing the protrusion part.

30. A switch according to claim 28, wherein said rigid member has a Young's Modulus of 70–200 GPa.

31. A switch according to claim 28, wherein said rigid member is made of stainless steel.

32. A switch comprising:

a substrate comprising a fixed contact and a conducting circuit arranged thereon;

a plurality of spring members positioned on a surface of the substrate via the fixed contact;

a resin sheet supported by external surfaces of said spring members and said surface of said substrate;

a substantially rigid member, which is substantially planar, positioned adjacent to said resin sheet and supported by a supporting member, comprising a plurality of protrusion parts protruding towards said spring members, and corresponding, respectively, to a center part of each of said spring members; and an actuator positioned adjacent to said substantially rigid member such that it can depress said center part of said spring member via said substantially rigid member to enable conduction.

33. A switch according to claim 32, wherein a circumferential portion of the substantially rigid member is connected to a side of said resin sheet facing the protrusion part.

34. A switch according to claim 32, wherein said rigid member has a Young's Modulus of 70–200 GPa.

35. A switch according to claim 32, wherein said rigid member is made of stainless steel.

36. A switch comprising:

a substrate comprising a fixed contact and a conducting circuit arranged thereon;

a spring member having a rotationally symmetrical axis, and arranged on said substrate such that an external periphery thereof contacts said fixed contact and said conducting circuit is arranged along said rotationally symmetrical axis;

a resin sheet supported by an external surface of said spring member and said surface of said substrate;

a substantially rigid member, which is substantially planar, positioned adjacent to said resin sheet and supported by a supporting member; and an actuator positioned adjacent to said substantially rigid member and substantially along said rotationally symmetrical axis, wherein:

if said actuator is moved along said rotationally symmetrical axis, said spring member is depressed via said substantially rigid member to contact said conducting circuit;

said resin sheet has a flat portion that is connected to said surface of said substrate; and said substantially rigid member further comprises:

a cylindrically shaped protrusion part that protrudes toward said spring member, and a circumferential part that is secured to said flat portion of said resin sheet, wherein an axis of said cylindrically shaped protrusion part is aligned with said rotationally symmetrical axis of said spring member.

37. A switch according to claim 36, wherein the circumferential portion of the substantially rigid member is adhered to a side of said flat portion of said resin sheet facing the protrusion part.

38. A switch according to claim 36, wherein said rigid member has a Young's Modulus of 70–200 GPa.

39. A switch according to claim 36, wherein said rigid member is made of stainless steel.

40. A multi-directionally operable switch comprising:

a printed wired substrate having a fixed contact and a conducting circuit arranged thereon;

a plurality of spring members generally arranged to form a cross shape, connected to said printed wired substrate via said fixed contact, and supporting a resin sheet on external surfaces thereof;

a substantially rigid member positioned adjacetn to said spring members and connected to said resin sheet by plastic sheeting;

said rigid member which is substantially planar, comprising a plurality of protrusion parts protruding towards said spring members and corresponding to a center part of each of said spring members; and an actuator positioned on an opposite side of said rigid member from said protrusion parts.

41. A multi-directionally operable switch according to claim 40, wherein a circumferential portion of the substantially rigid member is connected to a side of said resin sheet facing the protrusion part.

42. A switch according to claim 40, wherein said rigid member has a Young's Modulus of 70–200 GPa.

43. A switch according to claim 40, wherein said rigid member is made of stainless steel.

* * * * *